United States Patent [19]

Ishikawa

[11] Patent Number: 5,043,253

[45] Date of Patent: Aug. 27, 1991

[54] METHOD FOR COMMONLY PROCESSING TWO DIFFERENT SILVER HALIDE COLOR PHOTOGRAPHIC LIGHT-SENSITIVE MATERIALS

[75] Inventor: Takatoshi Ishikawa, Minami-ashigara, Japan

[73] Assignee: Fuji Photo Film Co., Ltd., Minami-ashigara, Japan

[21] Appl. No.: 282,256

[22] Filed: Dec. 9, 1988

[30] Foreign Application Priority Data

Dec. 11, 1987 [JP] Japan ..... 62-313408

[51] Int. Cl.[5] ..... G03C 5/38; G03C 7/30

[52] U.S. Cl. ..... 430/393; 430/430; 430/434; 430/460; 430/465; 430/464; 430/467; 430/933

[58] Field of Search ..... 430/397, 430, 434, 460, 430/463, 464, 467, 933

[56] References Cited

U.S. PATENT DOCUMENTS

| | | | |
|---|---|---|---|
| 2,657,140 | 10/1953 | Kessels | 430/953 |
| 2,815,284 | 12/1957 | Tausch | 430/933 |
| 3,127,270 | 3/1964 | Wilson | 430/933 |
| 3,269,840 | 8/1966 | Pattyn et al. | 430/933 |
| 3,592,645 | 7/1971 | Weyerts et al. | 430/933 |
| 3,677,762 | 7/1972 | Amano et al. | 430/933 |
| 3,743,531 | 7/1973 | Ducharme | 430/933 |
| 3,779,766 | 12/1973 | Tsuji et al. | 430/933 |
| 4,232,112 | 11/1980 | Kuse | 430/393 |
| 4,336,326 | 6/1982 | Evans | 430/933 |
| 4,774,167 | 9/1988 | Koshimizu et al. | 430/380 |
| 4,818,673 | 4/1989 | Ueda et al. | 430/393 |
| 4,966,834 | 10/1990 | Ishikawa | 430/393 |

FOREIGN PATENT DOCUMENTS 147148 7/1985 European Pat. Off. .

OTHER PUBLICATIONS

Derwent Abstracts-J61 134759, Konishiroku, 6/86, "Automatic Developing Machine . . . ".

Derwent Abstracts-J58 095342, Konishiroku, 6/83, "Continuous Treatment . . . ".

Derwent Abstracts-J59 111147, Konishiroku, 6/84, "Dye-Image Formation . . . ".

*Primary Examiner*—Charles L. Bowers, Jr.

*Assistant Examiner*—Patrick A. Doody

*Attorney, Agent, or Firm*—Burns, Doane, Swecker & Mathis

[57] ABSTRACT

In a method for processing at least 2 kinds of silver halide color photographic light-sensitive materials comprising the steps of development, desilvering, water washing and/or stabilization, the method comprises processing, in a common desilvering bath, one silver halide color photographic light sensitive material having, applied to a substrate, a silver halide emulsion layer which contains, on average, not less than 3 mole % of silver iodide and another silver halide color photographic light sensitive material having, applied to a substrate, a silver halide emulsion layer which is substantially free of silver iodide, the desilvering bath containing a processing solution having bleaching ability which contains at least one stilbene type fluorescent brightener and a processing solution having fixing ability which contains iodide ions ranging from $1\times10^{-4}$ to $1\times10^{-1}$ mole/l. The method makes it possible to reduce the space for installing the processing machine and the amount of waste liquor and to simplify the processing operations.

14 Claims, 1 Drawing Sheet

METHOD FOR COMMONLY PROCESSING TWO DIFFERENT SILVER HALIDE COLOR PHOTOGRAPHIC LIGHT-SENSITIVE MATERIALS

BACKGROUND OF THE INVENTION

The present invention relates to a method for processing silver halide color photographic light-sensitive materials and more particularly to a method for processing at least two kinds of such materials, in which one color light-sensitive material provided thereon with a coated emulsion layer having a silver iodide content of not less than 2 mole % and another color light-sensitive material provided thereon with a coated emulsion layer substantially free of silver iodide can be processed in the common (same) processing solution(s), whereby the size of a processing apparatus can be minimized and operations thereof can greatly be simplified.

Silver halide color photographic light-sensitive materials (hereunder referred to as "color light-sensitive material(s)") can roughly be grouped into the following two classes: one of which is color light-sensitive materials for taking photographs represented by color negative films and the other of which is color light-sensitive materials for print represented by color paper. These color light-sensitive materials have conventionally be processed only in large-scale photofinishing laboratories, but recently a small-sized processing system called "Minilabo" has been developed and thus they are now processed even in photography shops.

For such small-sized processing systems, it is of primary importance to have a small area for installation and a small working space required thereof since they are generally installed within a narrow space such as the space within a shop. For this reason, there has been a strong need for the development of a processing method which allows for an automatic developing machine comprising a processing system to minimize and which makes it possible to simplify processing operations.

Responding to the aforementioned demands, Japanese Patent Un-examined Publication (hereunder referred to as "J. P. KOKAI") Nos. 60-129747, 60-129748 and 61-134759 propose integrated automatic developing machines which can process color light-sensitive materials for taking photographs and those for print, which are conventionally processed separately, in the same processing bath(s) during a part or whole of the processes. If such an idea could be realized, the foregoing two kinds of color light-sensitive materials can indeed be processed using a single automatic developing machine, thus the space for installation thereof can substantially be reduced and the operations can be simplified since the number of processing solutions or baths to be provided or used can be substantially minimized. However, the foregoing patents simply propose ideas that different kinds of color light-sensitive materials are processed in the same bath(s) and do not disclose solutions of the problems associated with such a processing in the same processing solution(s).

The color light-sensitive materials for print such as color paper are generally formed using a silver chlorobromide, silver chloride or silver bromide emulsion substantially free of silver iodide (average AgI content thereof=not more than 1 mole %). Contrary to this, the color light-sensitive materials for taking photographs such as color negative films are obtained using a silver iodobromide emulsion having an average AgI content of not less than 3 mole % for the purpose of enhancing its sensitivity and graininess of the resultant light-sensitive 67 herein means the ratio (expressed in mole %) of the total 87 halides included in the light-sensitive emulsion layer.

It has gradually become clear that various problems arise when color light-sensitive materials greatly different in their halogen compositions inclusive of such silver iodide contents are processed in the same processing solution(s) or bath(s).

In particular, when two kind of color-sensitive materials different in the AgI contents are processed in a common desilvering process, it has been found that the desilvering rate of both these light-sensitive materials becomes low.

SUMMARY OF THE INVENTION

An object of the present invention is to provide a method for processing at least two light-sensitive materials in the same processing solution(s) which makes it possible to effectively solve the problem of insufficient desilvering observed when the light-sensitive materials differing in their AgI content are processed in a common disilvering process simultaneously or separately.

Another object of the present invention is to provide a method for processing color light-sensitive materials which makes it possible to minimize the size of an apparatus used in the method and to simplify the processing operations.

The present invention has been completed on the the basis of the finding that when color light-sensitive materials differing in their AgI contents are processed in the same desilvering process, the aforementioned problems can effectively be solved by utilizing a processing solution comprising a specific fluorescent brightener as a processing solution having bleaching ability and a processing solution comprising a specific amount of iodide ions as a processing solution having fixing ability.

Accordingly, the present invention provide the following method; in a method for processing at least two kinds of silver halide color photographic light-sensitive materials comprising the steps of development, desilvering, water washing and/or stabilization, the method comprises processing, in common desilvering bath, one silver halide color photographic light-sensitive material having, applied to a substrate, a silver halide emulsion layer which contains, on average, not less than 3 mole % of silver iodide and another silver halide color photographic light-sensitive material having, applied to a substrate, a silver halide emulsion layer which is substantially free of silver iodide, the desilvering bath containing a processing solution having bleaching ability which contains at least one stilbene type fluorescent brightener and a processing solution having fixing ability which contains iodide ions ranging from $1\times10^{-4}$ to $1\times10^{-1}$ mole/1.

DETAILED EXPLANATION OF THE INVENTION

Figure 1:
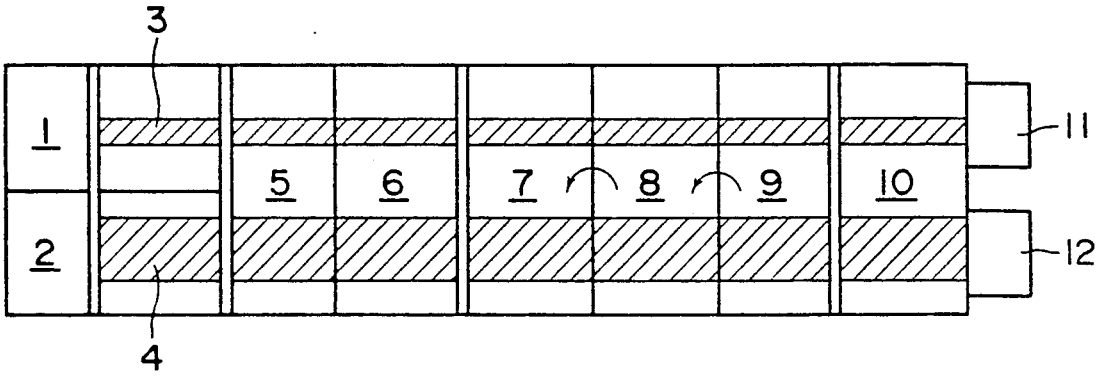
FIGS. 1 to 3 are diagrams schematically illustrating the processing apparatues used in the method of the present invention.

A technique for promoting desilvering effect by conducting color development processing in the presence of a 4,4'-diaminostilbene type fluorescent brightener is disclosed in J. P. KOKAI No. 59-111147. Moreover, the disilvering-promoting effect by a water-soluble iodide is also disclosed in U.K. Patent No. 926,569. However, if these techniques are used separately, they are almost ineffectual to eliminate the problem of insufficient desilvering effect accompanied by the processing in the same processing solution(s) as in the present invention. Therefore, it would be noteworthy that the desilvering properties are extremely improved only when a specific fluorescent brightener is present in a bath having bleaching ability and a specific amount of iodide ions are present in a bath having fixing ability as in the present invention.

The aforesaid effects of the present invention become more remarkable if a color light-sensitive material having a coated amount of silver less than a specific value and particularly the desilvering properties and the occurrence of processing stains are highly improved or suppressed if a color developer does not contain benzylalcohol substantially. The method of the present invention will be explained in more detail below.

In the processing of the present invention, color light-sensitive materials whose silver halide emulsion layer is formed from a silver iodobromide emulsion having a silver iodide content of not less than 2 mole %, particularly ranging from 3 to 30 mole % are processed. Specific examples thereof are color light-sensitive materials for taking photographs such as color negative films and color reversal films and reversal color paper. Particularly, color negative film are preferably processed by the method of the present invention.

In other word, the coated amount of silver of the light-sensitive materials is not more than 7 g/m$^2$, preferably 1 to 6 g/m$^2$ and thus high desilvering properties can be imparted to the light-sensitive materials.

On the other hand, the term "color light-sensitive materials substantially free of silver iodide" to be processed herein means the color light-sensitive materials substantially free of silver iodide whose average silver iodide content is not more than 1 mole % and specifically those used as light-sensitive materials for color print. In particular, light-sensitive materials for color print consisting essentially of silver chloride whose average silver bromide content is not more than 3 mole % are preferably processed in the present invention.

The coated amount of silver of these materials for color print is preferably not more than 0.8 g/m$^2$ and more preferably 0.4 to 0.75 g/m$^2$ from the viewpoint of desilvering properties.

The processing steps of the method of the invention will now be detailed below.

In the method of the invention, color light-sensitive materials having a silver iodide content of not less than 2 mole % and those substantially free from the same are first developed and then are procesed in a common desilvering process. In the color development, processing solution may be the same or different. The term "common desilvering processing" herein means that these light-sensitive materials differing in their silver iodide contents are processed in at least one common bath for the desilvering process separatedly or simultaneously. These light-sensitive materials are processed in water washing and/or stabilization baths after desilvering. The materials are, if necessary, processed in the same bath in such processes.

The processings in common baths are preferably performed in the same baths of one automatic developing machine as disclosed in, for instance, J. P. KOKAI Nos. 60-129747, 60-129748 and 61-134759, but the invention also includes embodiments in which color light-sensitive materials having a silver iodide content of not less than 2 mole % are processed in one of separate processing baths of one or two automatic developing machines while introducing the overflow thereof into the other processing bath in which those substantially free of silver iodide are processed.

Typical embodiments of the processing method of the present invention comprises the following processes, but the invention is not restricted to these specific examples. In the following examples of processes, common processes are enclosed in brankets.

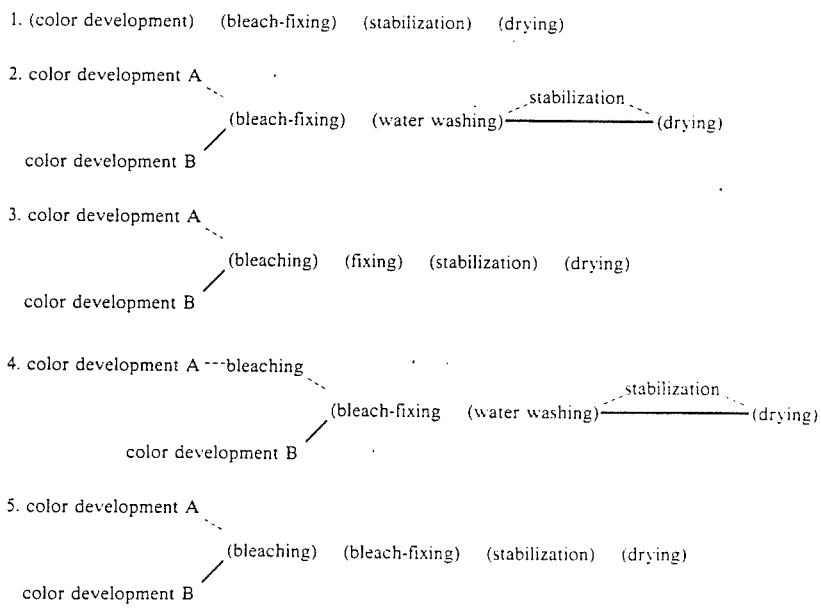

-continued 6. color development A
color development B
(bleaching) (fixing) (stabilization A) stabilization B (drying)

In the examples 1 to 6, the dotted line represents the movement of the light-sensitive materials having a silver iodide content of not less than 2 mole % and the solid line represents that of the materials substantially free of silver halide.

As mentioned above, each color light-sensitive material is processed in a common desilvering process after color development, in the present invention. In general, the desilvering process herein means bleaching, bleach-fixing, fixing processes.

The baths for bleaching and/or bleach-fixing processes contain at least one stilbene type fluorescent brighter. As the stilbene type fluroscent brighteners used in the invention, compounds represented by the following general formula (III) are preferably used:

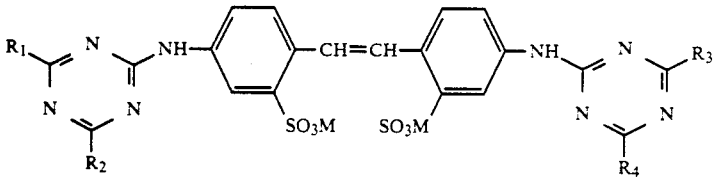

wherein $R_1$ to $R_4$ may be the same different and each represents a hydroxyl group, an alkoxy group having 1 to 4 carbon atoms such as a methoxy, ethoxy or methoxyethyoxy group; and amino group, an alkylamino group having 1 to 6 carbon atoms such as a methylamino, ethylamino, propylamino, dimethylamino, cyclohexylamino, beta-hydroxyethylamino, di-(beta-hydroxyethyl)-amino, beta-sulfoethylamino, N-(beta-sulfoethyl)-N-methylamino or beta-carboxyethylamino group; an aryloxy group such as a phenoxy or p-sulfophenyl group; an arylamino group such as an anilio, o-, m- or p-sulfoanilino, o-, m- or p-chloroanilino, o-, m- or p-toluidino, o-, m- or p-carboxyanilino, o-, m- or p-anisidino or o-, m- or p-hyroxyanilino group; or a halogen atom and M is a monovalent cation such as a sodium or potassium ion.

Specific examples of these compounds usable in the present invention are as follows, but the present invention is not restricted to these examples.

III-1

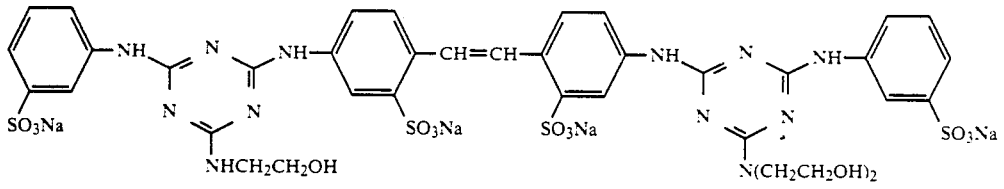

III-2

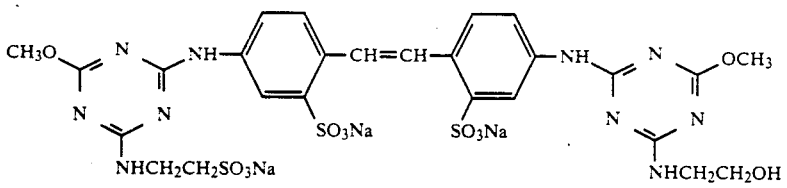

III-3

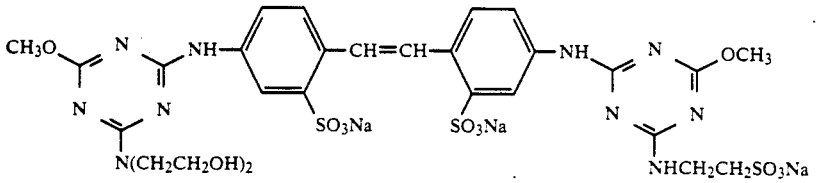

III-4

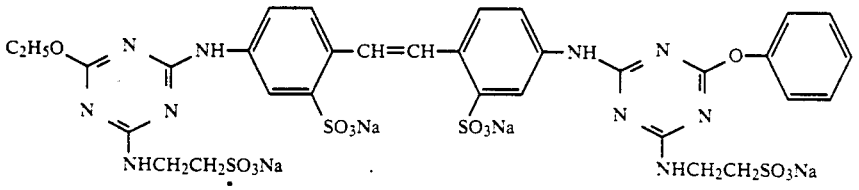

-continued
III-5
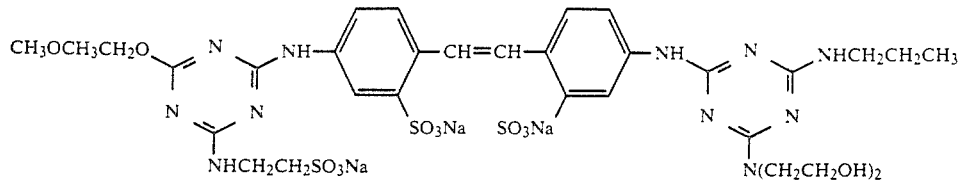
III-6
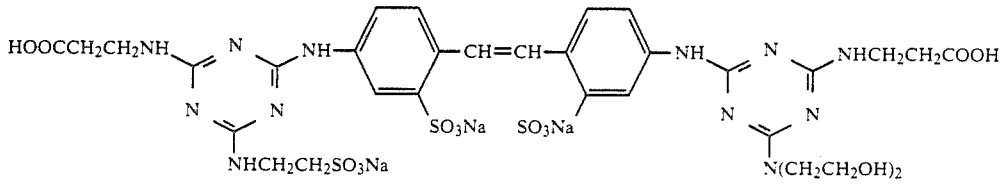
III-7
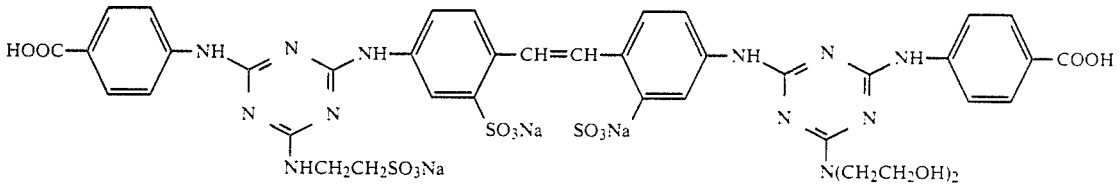
III-8
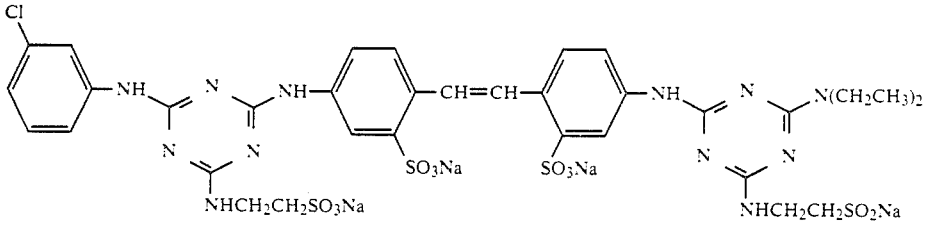
III-9
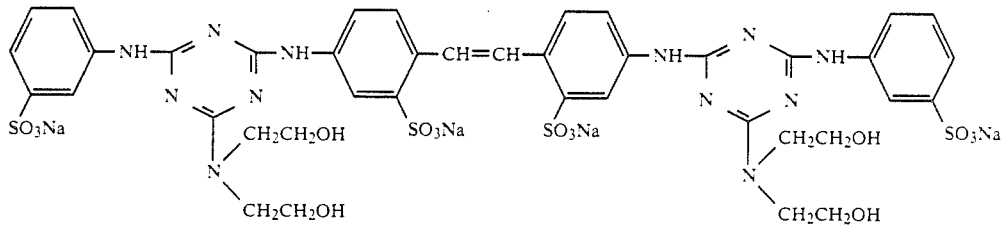
III-10
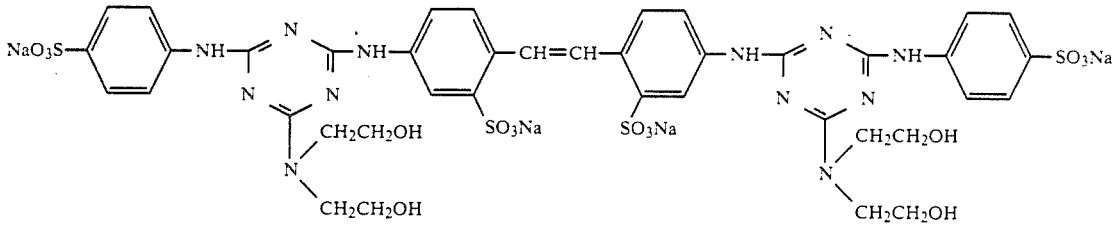
III-11
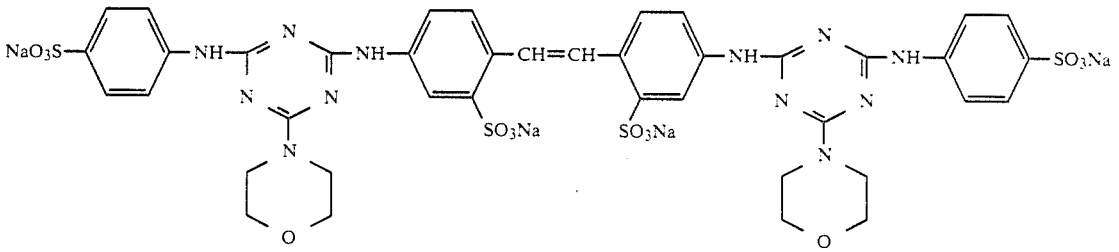

-continued
III-12
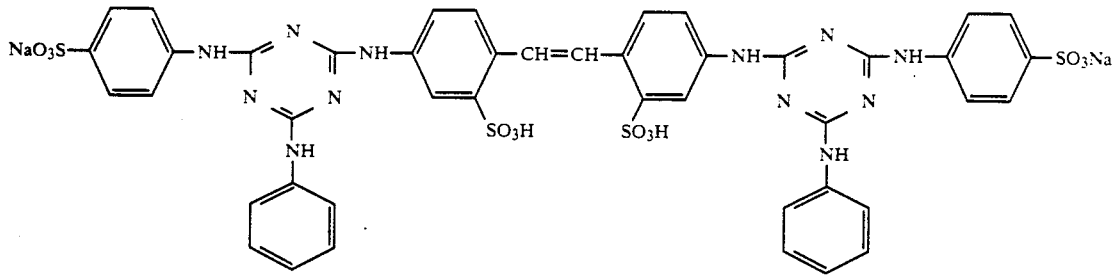
III-13
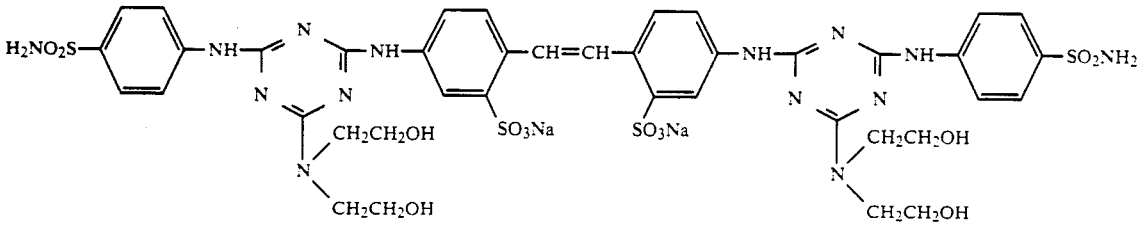
III-14
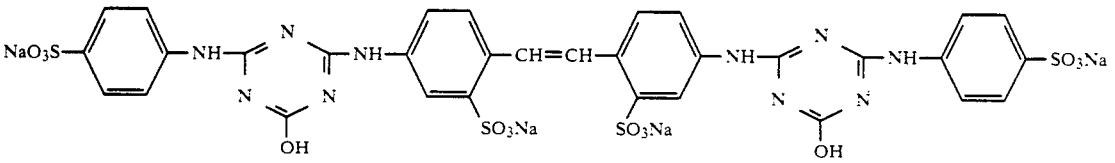
III-15
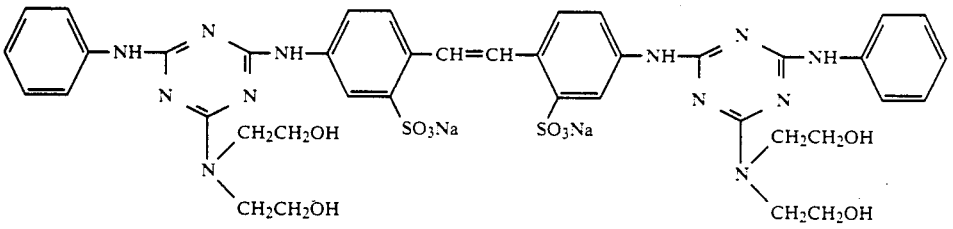
III-16
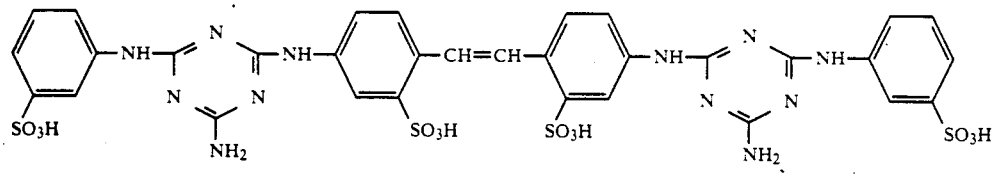
III-17
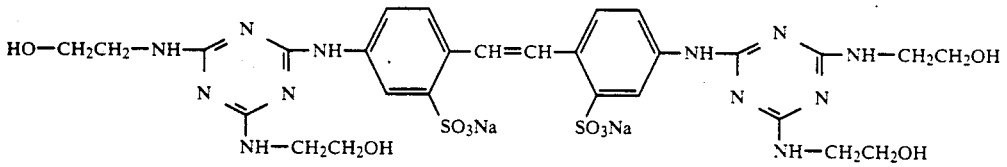
III-18
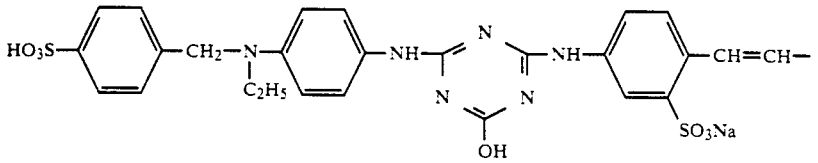

-continued
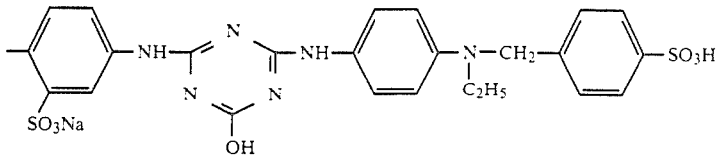
III-19
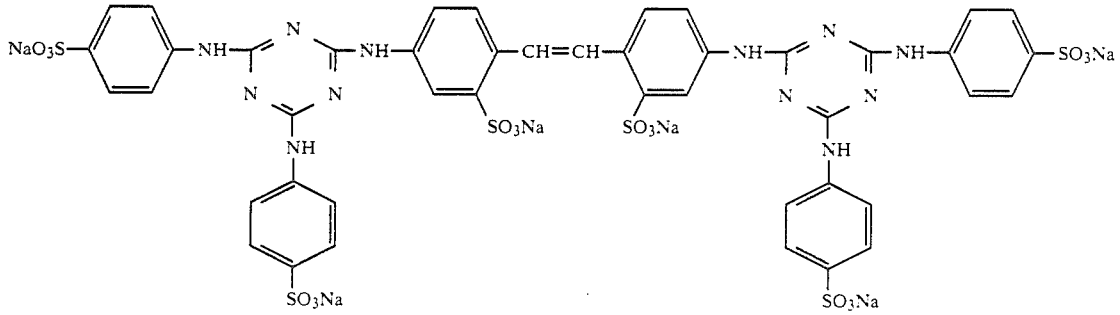
III-20
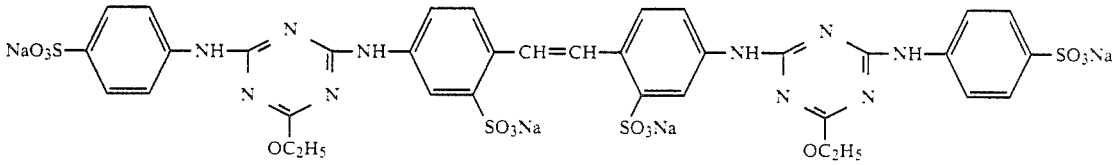
III-21
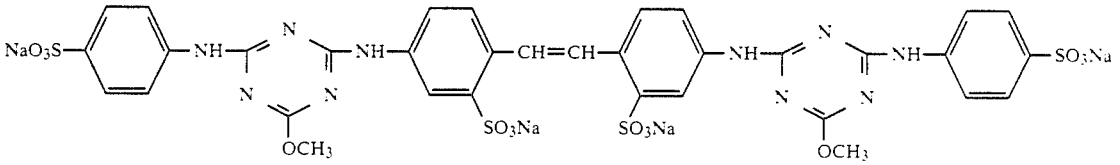
III-22
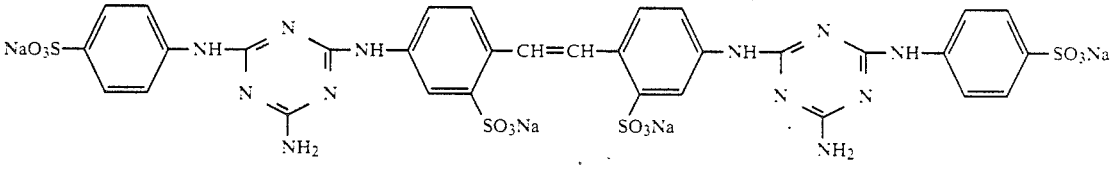
III-23
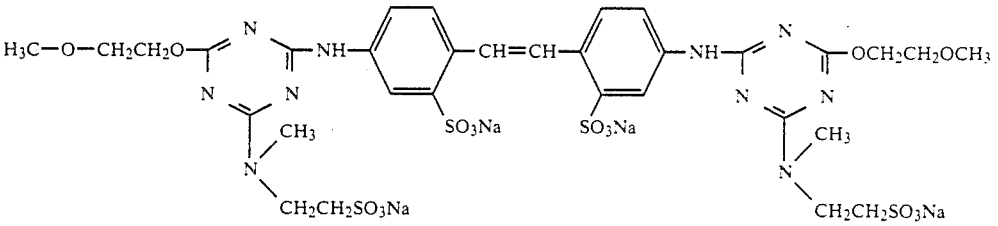
III-24
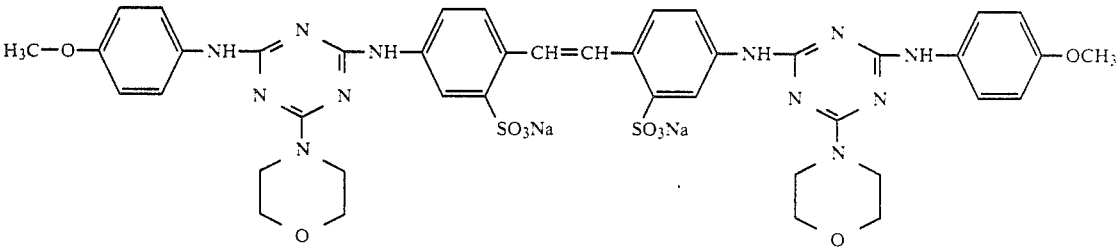

-continued
III-25
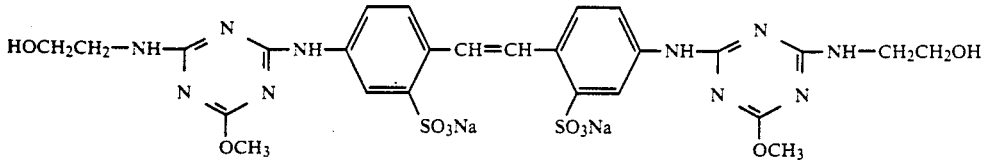
III-26
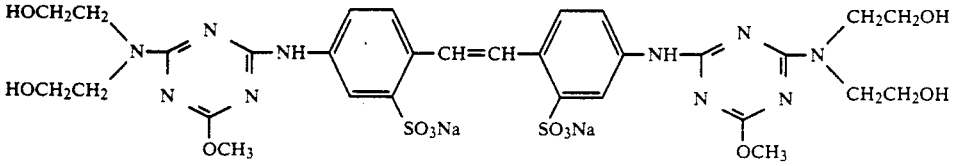
III-27
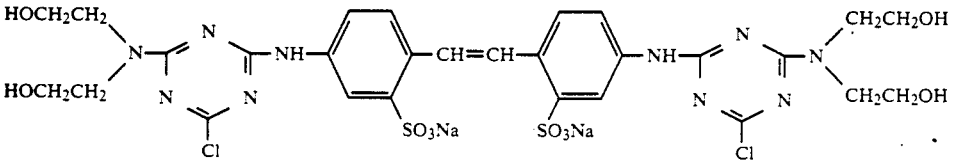
III-28
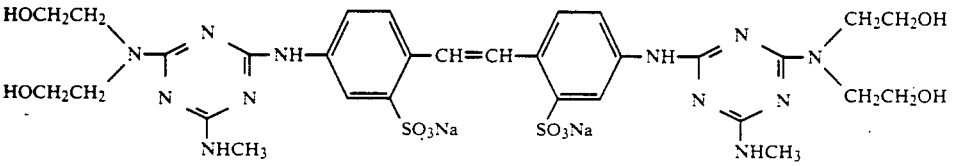
III-29
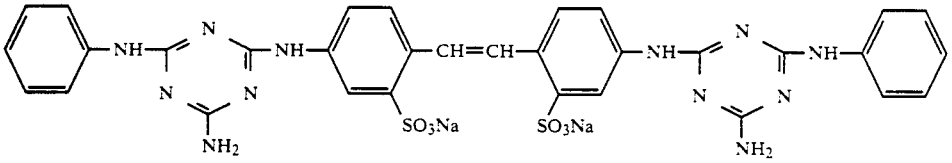
III-30
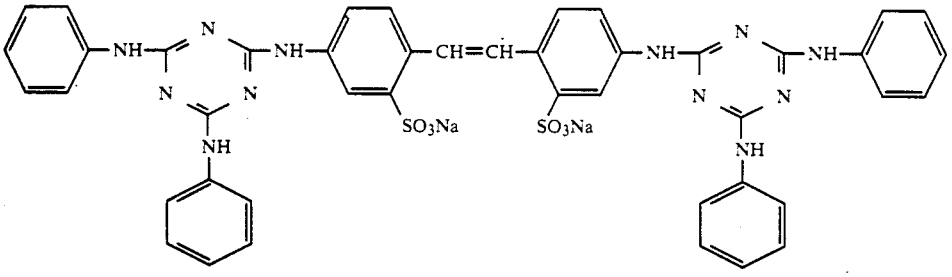
III-31
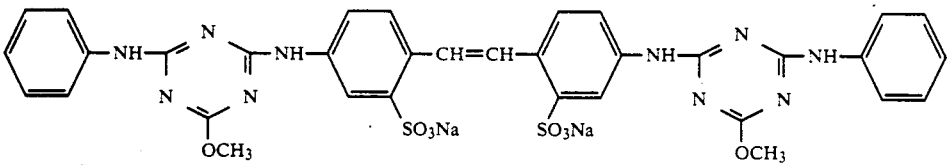
III-32
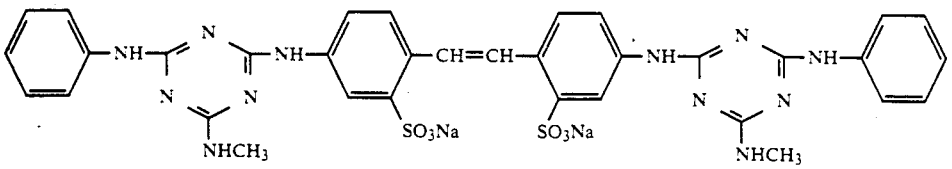

-continued
III-33
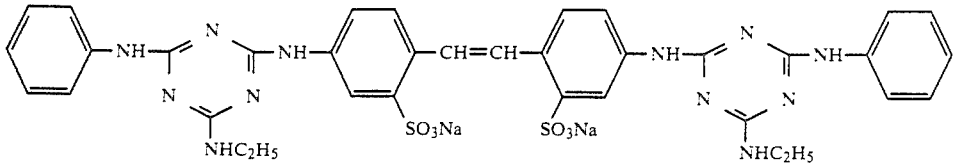
III-34
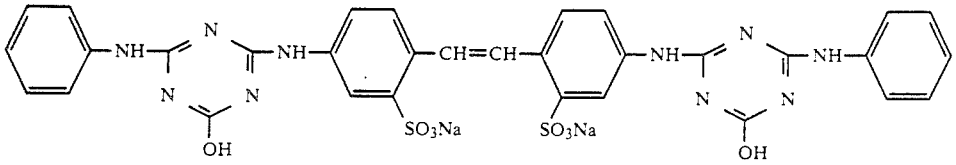
III-35
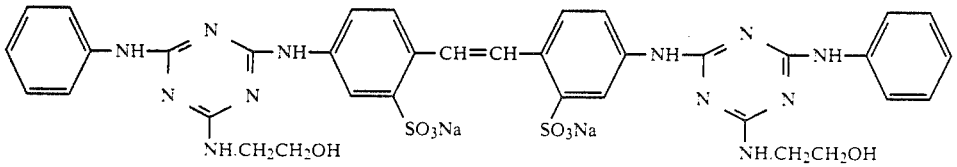
III-36
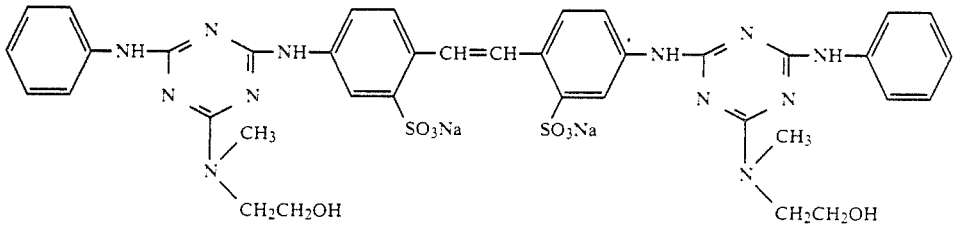
III-37
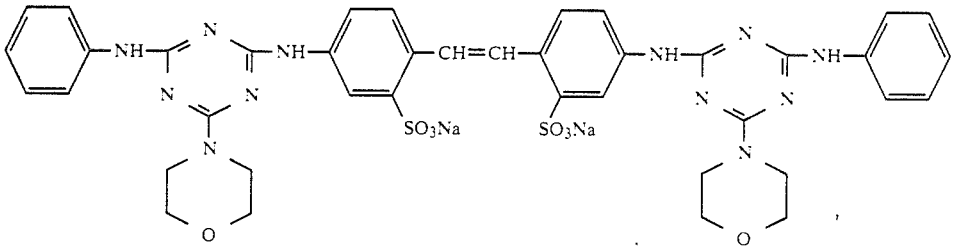
III-38
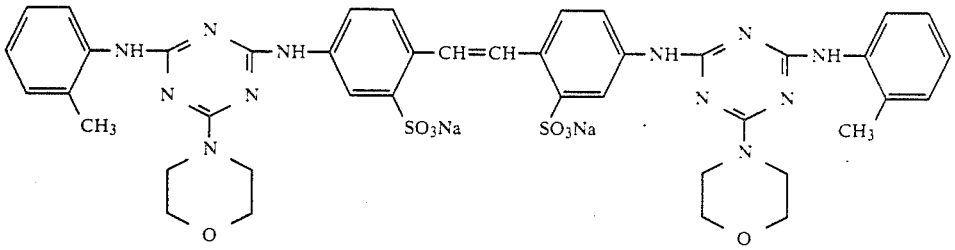
III-39
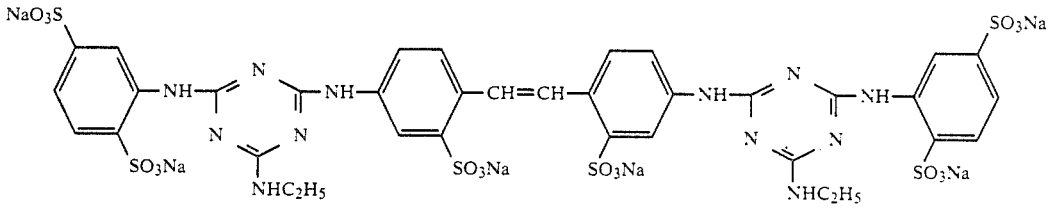
III-40
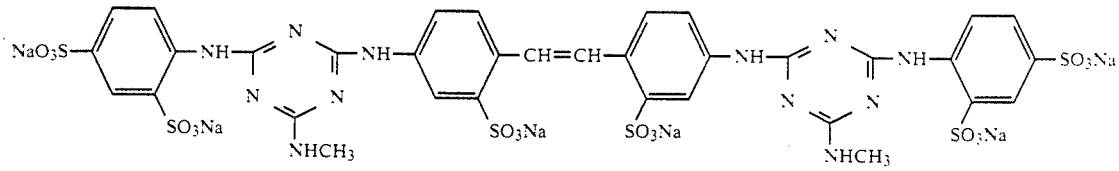

-continued

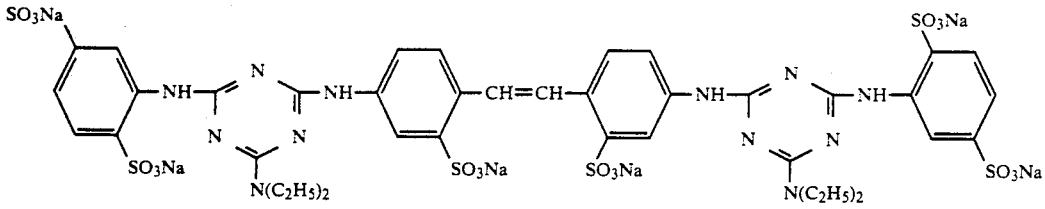

III-41

The diaminostilbene type brighteners usable in the invention can be prepared by an ordinary method disclosed in "KEIKOZOHAKUZAI (Fluorescent Brighteners)", edited by KASEIHIN KOGYOKAI (Association of Chemically Synthesized Products and Industries), issued on August, Showa 51 (1978), p.8.

The amount of these fluorescent brighteners added to a bleaching or bleach-fixing solution preferably ranges from 0.1 to 20 g, more preferably 0.2 to 15 g and most preferably 0.5 to 10 g per liter of the solution. A part or whole of the amount of these brighteners to be added may be carried over from the preceding bath(s) such as a developing bath.

Examples of the bleaching agents used in the bleaching and/or bleach-fixing solutions include polyvalent metal compounds such as those of iron(III), cobalt(III), chromium(IV) and copper(II); peracids, quinones, and nitro compounds and most preferred are complexes of iron(III) with organic acids. Specific examples of preferred bleaching agents include complexes of iron(III) and aminopolycarboxylic acids such as ethylenediaminetetraacetic acid, diethylenetriaminepentaacetic acid. cyclohexanediaminetetraacetic acid, 1,3-diaminopropanetetraacetic acid, methyliminodiacetic acid and glycol ether diaminetetraacetic acid. These complexes can be used in a variety of combinations as described in Research Disclosure No. 24023 (April, 1984).

The amount of these bleaching agents ranges from 0.05 to 0.5 mole and preferably 0.1 to 0.4 mole per liter of the solution.

The bleaching and/or bleach-fixing solutions preferably contain a bleaching accelerator for rapid processing. Preferred examples of the bleaching accelerators are compounds having mercapto groups or disulfide bonds as disclosed in U.S. Pat. No. 3,893,858; German Patten. No. 1,290,812; J.P. KOKAI No. 53-95630 and Research Disclosure No. 17129 (July, 1978), halides as disclosed in J.P. KOKOKU No. 53-11854 and compounds as disclosed in U.S. Pat. No. 4,552,834. These bleaching accelertors are added to the solution in an amount ranging from 0.001 to 0.05 mole/l.

In addition to the foregoing components, the bath having bleaching ability used in the invention may further comprise halides such as potassium iodide and ammonium bromide; nitrate ions for preventing corrosion, various surfactants and the like.

Referring now to the processing bath having fixing ability, the term "processing solution having fixing ability" herein means the processing bath capable of dissolving silver halides and generally referred to as "fixing and/or bleach-fixing baths".

The processing solution having fixing ability used in the invention is characterized by containing $1\times10^{-4}$ to $1\times10^{-1}$ mole/l of iodide ions. It is preferably $5\times10^{-4}$ to $1\times10^{-2}$ mole/l. It is preferred that the iodide ions are added thereto in the form of an iodide. Specific examples thereof are ammonium iodide, potassium iodide and sodium iodide. Alternatively, iodide ions dissolved out from the processed light-sensitive materials may also be utilized. In other words, the objects of the present invention can more effectively be achieved by utilizing a processing solution having fixing ability (inter alia, bleach-fixing solution) whose iodide ion content is limited to a specific amount when at least two kinds of color light-sensitive materials differing in their silver iodide contents are processed in the same processing solutions. Such a result cannot be predicted from the conventional knowledges. The content of iodide ions is critical in the present invention. This is because if it is less than $1\times10^{-4}$ mole/l, it becomes difficult to perform rapid processings and on the contrary, if it is more than $1\times10^{-1}$ mole/l, the bleaching rate is improved, but the problem of insufficient desilvering arises.

The bath having fixing ability used in the present invention comprises fixing agents. Examples thereof include thiosulfates, thioethers, thiourea and iodides and most commonly used are thiosulfates, particularly ammonium thiosulfate. The amount thereof used in the processing solution having fixing ability ranges from 0.3 to 3 mole/l and preferably 0.5 to 2 mole/l.

in addition, preservatives for the thiosulfates such as sulfites, bisulfites, carbonyl-bisulfite adducts and sulfinic acids are also added to the solution.

The pH values of the bleaching, fixing and bleachfixing solutions used herein can be set at 3 to 9 respectively and preferably 4 to 8. In this connection, it is preferably set at 4 to 6 in particular in rapid processings.

The temperature in each processing is 25° to 45° C., preferably 30° to 40° C. When rapid processing is required, it is preferably set at a high temperature.

The processing time is 20 seconds to 3 minutes for color light-sensitive materials substantially free from silver iodide and 20 seconds to one minute for the rapid processings. On the other hand, it is set at 1 to 5 minutes for color light-sensitive materials having a silver iodide content of not less than 2 mole % and 1 to 3 minutes for the rapid processings.

In the present invention, the amount of the replenisher for each processing solution is 20 to 300 ml/m$^2$ for the color light-sensitive materials substantially free from silver iodide and 100 to 1200 ml/m$^2$ for the color light-sensitive materials containing not less than 2mole % of AgI. However, it is preferably as low as possible from the viewpoint of the objects of the invention and specifically it is preferably not more than 200 ml/m$^2$ for the former and not more than 800 ml/m$^2$ for the latter.

The processing steps and the processing solutions used herein will be detailed below.

The color developer used in the invention is preferably an alkaline aqueous solution comprising, as a principal component, aromatic primary amine type color developing agent. Preferably used are p-phenylenediamine type developing agents whose typical examples include 3-methyl-4-amino-N,N-diethylaniline, 3-methyl-4-amino-N-ethyl-N-(beta-hydroxyethyl)-aniline, 3-methyl-4-amino-N-ethyl-N-(beta-methanesulfonamidoethyl) -aniline, 3-methyl-4-amino-N-ethyl-N-(beta-methoxyethyl)-aniline; and sulfates, hydrochlorides, phosphates and p-toluenesulfonates thereof. These diamines in the form of salts are in general more stable than those free state and, therefore, they are preferably used in the form of salts. Among these, preferred are (1) 3-methyl-4-amino-N-ethyl-N-(beta-hydroxyethyl)aniline and (2) 3-methyl-4-amino-N-ethyl-N-(beta-methanesulfonamidoethyl)-aniline and it is sometimes preferable to use these in combination.

In the invention, the color light-sensitive materials may be processed in the same color developer. In such a case, the developer preferably contains the developing agent (1) alone or the combination of (1) and (2).

The developing agent is usually used in an amount ranging from 1 to 15 g/l, preferably 2 to 10 g/l and more preferably 3 to 8 g/l.

The color developer further comprises a variety of preservatives, for instance, hydroxylamines such as hydroxylamine and diethylhydroxylamine; hydrazines; aromatic polyhydroxy compounds such as catechol disulfonic acid and catechol trisulfonic acid; polyethylenediamine-(1, 4-diazabicyclo(2,2,2)octanes); sulfites; and bisulfites.

An additive simultaneously serving as a preservative and a suspension stabilizer is used in the color developer. Examples of such agents include various metal chelateforming compounds, for instance, aminopolycarboxylic acids such as ethylenediaminetetraacetic acid, diethylenetriaminepentaacetic acid, hydroxyethyliminodiacetic acid and cyclohexanediaminetetraacetic acid; aminopolyphosphonic acids such as ethylenediaminetetramethylene phosphonic acid, nitrilotrimethylene phosphonic acid; and alkylidene diphosphonic acids represented by 1-hydroxyethylidene-1,l-diphosphonic acid.

The color developer used in the invention may further comprises, in addition to the foregoing components, color development accelerators such as benzylalcohol, polyethylene glycol, quaternary ammonium salts, amines and 3,6-thiaoctane-1,8-diol; auxiliary agents for the development such as 1-phenyl-3-pyrazolidone; compounds competing with the color developing reaction such as citrazinic acid and hydroquinone; antifoggants such as bromides, iodides, benzimidazoles and benzothiazoles; developing inhibitors; pH buffering agents such as carbonates, borates and phosphates; and optionally diaminostilbene type fluorescent brighteners depending on purposes.

The pH value of the color developer is usually set at 9 to 12, but in most cases 9.5 to 10.5. The color development processing is commonly performed with supplementing the color developer (replenisher). The amount thereof are typically 50 to 400 ml/m$^2$ for the color light-sensitive materials substantially free from silver iodide and 400 to 1200 ml/m$^2$ for those having a silver iodide content of not less than 2 mole %. If the amount of the color developer supplemented is to be saved, the concentration of bromides in the replenisher is preferably not more than 0.004 mole/1. In a replenisher-saved processing, the contact areas between the processing solution and air should be reduced as low as possible to prevent the solution from evaporating off and undergoing oxidation.

The color development is performed at a temperature of 25° to 45° C, preferably 30° to 40° C. in the present invention. The processing time thereof may vary depending on the kinds of the processed light-sensitive materials. For the color light-sensitive materials substantially free from silver iodide, it is generally 30 seconds to 4 minutes and 30 to 100 seconds for rapid processings while for the color light-sensitive materials having a silver iodide content of not less than 2 mole %, it generally ranges from 1 to 4 minutes and 1 to 2.5 minutes for rapid processings.

The processing solutions used in the desilvering process are the bleach-fixing, bleaching, fixing solutions as explained above.

In the present invention, the color light-sensitive materials are generally subjected to water washing and/or stabilization processes after desilvering. The amount of washing water can be widely changed depending on various conditions such as properties of the color light-sensitive materials to be processed (for instance, materials used such as couplers), applications thereof, the temperature of the washing water, the number of tanks for water washing (stage number) and manners for supplementing the replenisher such as direct flow and countercurrent flow systems. Among these, the relationship between the number of tanks for water washing and the amount of water in the multi-stage countercurrent flow system can be obtained by the method disclosed in Journal of the Society of Motion Picture and Television Engineers, 1955 (May), Vol. 64, pp. 248–253.

in accordance with the multi-stage countercurrent flow system described in the above reference, the amount of the washing water can be substantially reduced, but bacteria proliferate and the resultant floating substances are adhered to the processed light-sensitive materials since the residence time of the water in the tanks is greatly increased.

In the processing of the color light-sensitive materials, such a problem can effectively be solved by adopting the method for reducing the amount of calcium and magnesium ions disclosed in Japanese Patent Application Ser. (hereunder referred to as "J.P.A.") no. 61-131632. Alternatively, this problem can also be solved by using isothiazolone compounds and thiabendazoles disclosed in J.P. KOKAI No. 57-8542; such chlorine type antibacterial agents as sodium chlorinated isocyanurates disclosed in J.P. KOKAI No. 61-120145; benzotriazoles disclosed in J.P.A. No. 60-105487; or other antibacterial agents disclosed in "BOKIN BOBAIZAI NO KAGAKU (Chemistry of Antibacterial and Antifungus Agents)", Hiroshi HORIGUCHI; "BISEIBUTSU NO MEKKIN, SAKKIN AND BOBAI GIJUTSU (Sterilization, Pasteurization and Mold Controlling Techniques)", edited by Sanitary Engineering Society; and "Dictionary of Antibacterial and Antifungus Agents", edited by Japan Bacteria and Fungi Controlling Society.

In the present invention, the pH value of the washing water is 4 to 9 and preferably 5 to 8. The temperature and time of the water washing may vary depending on, for instance, the properties and applications of the color light-sensitive materials to be processed, but in general the water washing is performed at a temperature of 15° to 45° C. for 20 seconds to 10 minutes, preferably 25° C. to 40° C. for 30 seconds to 5 minutes.

In the invention, the color light-sensitive materials are directly processed with a stabilization solution instead of the water washing process. In such a stabilization process, any known methods disclosed in J.P.

KOKAI Nos. 57-8543, 58-14834 and 60-220345 can be employed.

Additionally, the stabilization process may be carried out subsequent to the water washing process and examples thereof are stabilization baths containing formalin and a surfactant, which is used as the final bath for processing color light-sensitive materials for taking photographs. The stabilization solution may contain a variety of chelating agents and/or antifungus agents.

The overflows associated with the supplementation of a replenisher to the water washing and/or stabilization processings may be introduced into other baths such as those for the desilvering process to reuse them.

In the present invention, each processing solution is used at a temperature of 10° to 50° C. It generally ranges from 30° C. to 38° C., but higher temperature may be used to promote the processing and to thus reduce the processing time or lower temperature may also be used to improve the quality of images or the stability of the processing solution. Moreover, to save the amount of silver in the color light-sensitive materials, processings utilizing cobalt intensifier or hydrogen peroxide intensifier disclosed in German Patten No. 2,226,770 or U.S. Pat. No. 3,674,499 can be employed.

Each processing bath may be provided with a heater, a temperature sensor, a level sensor, a circulation pump, a filter, a floating cover, a squeezy and the like according to need.

The color light-sensitive materials to be processed in the method of the invention will be detailed below.

The silver halide emulsion for use in making the light-sensitive layer of the color light-sensitive materials processed in the invention contains at least one member selected from the group consisting of silver chloride, silver bromide and silver iodide. However, it is preferred for color paper to use silver chloride or silver bromide substantially free from silver iodide. The term "substantially free from silver iodide" herein means silver halides whose silver iodide content is not more than 1 mole %, preferably not more than 0.3 mole %, more preferably not more than 0.1 mole % and most preferably zero with respect to the total amount of silver halides.

Preferred silver halide emulsions for color paper used in the invention are silver chlorobromide emulsions whose silver chloride content is not less than 10 mole %. In particular, to obtain emulsions having sufficient sensitivity without increasing fogging, the silver bromide content is preferably not less than 20 mole %, provided that if a rapid processing in which the developing time is reduced is necessary, it is preferable to use silver chlorobromide emulsion whose silver bromide content is not more than 10 mole %, more preferably not more than 3 mole % and most preferably silver chloride emulsion substantially free from silver bromide (AgBr content =not more than 1 mole %).

If emulsions having low silver bromide content are used, not only the rate of development is enhanced but also the activity of the developer can be maintained by supplementing lesser amount of the replenisher since the bromide ions dissolved out from the light-sensitive materials is greatly reduced when such a material having a low silver bromide content is processed.

The emulsions for use in making the light-sensitive layer of color negative films comprises silver iodobromide or silver iodochlorobromide whose silver iodide content is not more than 30 mole % and particularly silver iodobromide having a silver iodide content ranging from 3 to 25 mole %. More preferred silver iodide content in the present invention ranges from 3 to 11 mole % and most preferably 3 to 8.0 mole %.

Silver halide grains present in the photographic emulsions may be so-called regular grains having regular crystal shape such as cubic, octahedral, tetradecahedral or polydodecahedral or those having irregular crystal shape such as spheric or those having crystal defects such as twinning plane or those having composite forms thereof.

The silver halide grains may be fine grains having a diameter of not more than about 0.1 micron or large-sized grains having a diameter of the projected area up to 10 microns. The silver halide emulsion may be monodisperse one having a narrow grain-size distribution or polydisperse one having a wide grain-size distribution.

The silver halide photographic emulsions can be prepared by a known method such as those disclosed in Research Disclosure (RD) No. 17643 (December, 1978), pp. 22–23 "I. Emulsion Preparation and Types" and ibid, No. 18716 (November, 1979), p. 648.

The photographic emulsions used herein can be prepared by the methods as disclosed in P. Glafkides, Chimie et Physique Photographique, Paul Montel, 1967; G. F. Duffin, Photographic Emulsion Chemistry, Focal Press, 1966; and V.L. Zelikman et al., Making and Coating Photographic Emulsion, Focal Press, 1964.

In the present invention, it is preferred to use monodisperse emulsions. A typical monodisperse emulsion contains silver halide whose average grain size is not less than 0.1 micron and of which at least about 95% by weight has a grain size within the average grain size±40%. An emulsion containing silver halide whose average grain size is about 0.25 to 2 micron and of which at least about 95% by weight or by number has a grain size within the average grain size±20% may be used in the present invention.

The tabular silver halide grains having an aspect ratio of not less than about 5 can be used in the invention. Such tabular grains may easily be prepared by the method as disclosed in Gutoff, Photographic Science and Engineering, 1970, Vol. 14, pp. 248–257; U.S. Pat. Nos. 4,434,226; 4,414,310; 4,433,048 and 4,439,520 and U.K. Patent No. 2,112,157. The above cited U.S. Pat. No. 4,434,226 details that various effects such as improvement in the color sensitization due to a sensitizing dye, improvement in the graininess and increase in sharpness can be attained if the tabular grains are used.

Regarding the crystalline structure of the silver halides, it may be uniform or those having different compositions between the inner and outer portions. Typical examples of the latter are core-shell type or dual structure type ones in which the halogen composition in the inner portion thereof differs from that of the surface area. In such grains, the shape of the core may be the same or different from that of the whole grain inclusive of the shell.

Specifically, the shape of the core is cubic and that of the whole grain is cubic or octahedral or vise versa. Moreover, it may be triple or higher structure or further those composed of double structure to which a thin layer of silver halide having a different composition is applied.

In the method of this invention, emulsions composed of silver halide grains having any structure rather than those composed of grains having a uniform comosition are preferably used. In the silver chlorobromide emulsions used for preparing color paper, grains whose silver bromide content at the surface area is less than that of the inner portion thereof are preferably used. Typical example is the emulsion composed of core-shell type grains in which the core portion has a silver bromide content higher than that of the shell. The difference in the silver bromide content between the core and shell portions is preferably not less than 3 mole % and not more than 95 mole % and the ratio (molar ratio) of the amount of silver in the core portion to that in the shell portion preferably ranges from 5:95 to 95:5, more preferably 7:93 to 90:10.

on the other hand, in the silver iodobromide emulsion for preparing color negative films, the silver iodide content of the core portion is preferably higher than that in the shell portion and the silver iodide content of the core portion is 10 to 45 mole %, preferably 15 to 40 mole %. That in the shell portion is not more than 5 mole %, preferably not more than 1 mole %. The ratio of the amount of silver in the core portion to that in the shell portion is 15:85 to 85:15, preferably 15:85 to 75:25.

Examples of such silver halide grains are disclosed in U.K. Patent No. 1,027,146; U.S. Pat. Nos. 3,505,068 and 4,444,877 and J.P.A. No. 58-248469.

The silver halide photographic emulsions may be spectrally sensitized with methine dyes or the like. Examples of such dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes and complex merocyanine dyes.

Examples of the sensitizing dyes used herein are disclosed in Research Disclosure, Vol. 176, No. 17643, Item IV, p. 23 (December, 1978).

The sensitizing dyes may be incorporated into the photographic emulsions during any steps for preparing the same or at any time until the emulsion is applied. Examples of the former are process for forming silver halide grains, physical ripening process and chemical ripening process.

In particular, U.S. Pat. Nos. 4,183,756 and 4,225,666 disclose that advantages such as the increase in sensitivity and the enhancement of the adsorption of the sensitizing dyes by the silver halide grains can be achieved by adding the spectral sensitizing dyes to the emulsions after the formation of stable nuclei for forming silver halide grains.

The silver halide emulsions used in the invention may comprises a variety of compounds for the purposes of preventing fogging during the production, storage or photographic processings; or stabilizing photographic quality. Examples of such antifoggants or stabilizers are azoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazoles); mercaptopyrimidines; mercaptotriazines such as thioketo compounds e.g., oxazolinethione; azaindenes such as triazaindenes; tetraxaindenes particularly 4-hydroxy substituted (1,3,3n,7)tetrazaindenes and pentazaindenes; benzenethiosulfonic acid, benzenesulfonic acid and benzenesulfonamide. These compounds are disclosed in Research Disclosure Nos. 17643 and 18716 of which relevant passages are listed in the following Table.

| Kind of Additive | RD 17643 | RD 18716 |
|---|---|---|
| 1. Chemical Sensitizer | p. 23 | p. 648, right column |
| 2. Sensitivity Enhancing Agent | | p. 648, right column |
| 3. Spectral Sensitizing Agent Supersensitizing Agent | p. 23-24 | p. 648, right column to p. 649, right column |
| 4. Brightener | p. 24 | |
| 5. Antifoggant and Stabilizer | p. 24-25 | p. 649, right column |
| 6. Light Absorber, Filter Dye Ultraviolet Absorber | p. 25-26 | p. 649, right column to p. 650, left column |
| 7. Stain Resistant Agent | p. 25, left column | p. 650, left to right column |
| 8. Dye Image Stabilizer | p. 25 | |
| 9. Film Hardening Agent | p. 26 | p. 651, left column |
| 10. Binder | p. 26 | p. 651, left column |
| 11. Plasticizer, Lubricant | p. 27 | p. 650, right column |
| 12. Coating Aid, Surfactant | p. 26-27 | p. 650, right column |
| 13. Antistatic Agent | p. 27 | p. 650, right column |

The color light-sensitive materials to be processed in the present invention may contain a variety of color couplers. "Color coupler(s)" herein means a compound capable of forming a dye through coupling reaction with an oxidized form of an aromatic primary amine developing agent. Typical examples of useful color couplers include naphthol or phenol type compounds, pyrazolone or pyrazoloazole type compounds, and linear or heterocyclic ketomethylene compounds. Cyan, magenta and yellow color couplers which may be used in the present invention are disclosed in the patents cited in Research Disclosure No. 17643 (December, 1978) VII-D; and ibid No. 18717 (November, 1979).

The color couplers incorporated in light-sensitive materials are preferably made nondiffusible by imparting thereto ballast groups or polymerizing them. 2-Equivalent couplers which are substituted with coupling elimination groups are more preferable than 4-equivalent couplers in which a hydrogen atom is in a coupling active site, because the amount of coated silver can be decreased. Furthermore, couplers in which a formed dye has a proper diffusibility, non-color couplers, DIR couplers which release a development inhibitor through coupling reaction or couplers which release a development accelerator during coupling reaction may also be used.

A typical yellow couplers capable of being used in the present invention is an acylacetamide coupler of an oil protect type. Examples of these are disclosed in U.S. Pat. Nos. 2,407,210; 2,875,057 and 3,265,506. 2-Equivalent yellow couplers are preferably use din the present invention. Typical examples thereof include the yellow couplers of an oxygen atom elimination type disclosed in U.S. Pat. Nos. 3,408,194; 3,447,928; 3,933,501; and 4,022,620, or the yellow couplers of a nitrogen atom elimination type described in J.P. KOKOKU No. 55-10739; U.S. Pat. Nos. 4,401,752; and 4,326,024. Research Disclosure No. 18053 (April, 1979), U.K. Patent No. 1,425,020, DEOS Nos. 2,219,917; 2,261,361; 2,329,587 and 2,433,812. Alpha-pivaloyl acetanilide type couplers are excellent in fastness, particularly light fastness, of formed dye. Alpha-benzoyl acetanilide type couplers yield high color density.

Magenta couplers usable in the present invention include couplers of an oil protect type of indazolone, cyanoacetyl, or preferably pyrazoloazole such as 5-pyrazolone and pyrazolotriazole type ones. Among 5-pyrazolone type couplers, couplers whose 3-position is substituted with an arylamino or acylamino group are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896 and 3,936,015.

Particularly preferred magenta couplers are those represented by the following general formula (I) or (II) since the desilvering rate can be improved and the problem of the generation of magenta stains after the processing can be solved:

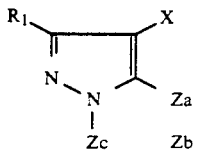

(I)

In the above general formula (I), $R_1$ represents a hydrogen atom or a substituent; X represents a hydrogen atom or a group capable of being eliminated through coupling reaction with an oxidized form of an aromatic primary amine developing agent; Za, Zb and Zc each represents a methine or substituted methine group or a group =N— or —NH— provided that one of the bonds Za—Zb and Zb—Zc is a double bond and the other is a single bond, that if the bond Zb—Zc is a carbon-carbon double bond, it may be a part of an aromatic ring, that the compound may form a dimer or a higher polymer at $R_1$ or X, and that if Za, Zb or Zc is a substituted methine group, the compounds may form a dimer or a higher polymer at the substituted methine.

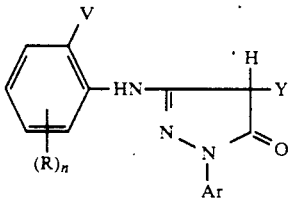

(II)

In the general formula (II), Ar represents an optionally substituted phenyl group; Y represents a group capable of being eliminated through coupling reaction with an oxidized form of an aromatic primary amine developing agent; V represents a halogen atom, an alkoxy group or an alkyl group; R represents a group which may be a substituent for the benzene ring and n is an integer of 1 or 2 provided that if n is 2, the groups R may be the same or different.

The compounds represented by formula (I) will hereunder be detailed.

In formula (I), $R_1$ represents a hydrogen atom or a substituent; X is a hydrogen atom or a group capable of being eliminated through coupling reaction with an oxidized form of an aromatic primary amine developing agent Za, Zb and Zc each represents a methine or substituted methine group or a group =N— or —NH— provided that one of the bonds Za—Zb and Zb—Zc is a double bond and the other is a single bond, that if the bond Zb—Zc is a carbon-carbon double bond, it may be a part of an aromatic ring, that the compound may form a dimer or a higher polymer at $R_1$ or X, and that if Za, Zb or Zc is a substituted methine group, the compounds may form a dimer or a higher polymer at the substituted methine.

In formula (I), the dimer or higher polymer herein means those having at least two groups represented by formula (I) in a molecule and may include bis-forms or polymeric couplers. The polymeric couplers may be a homopolymer simply composed of a monomer having a moiety represented by formula (I) (preferably those having a vinyl group (hereunder referred to as "vinyl monomer(s)")) or a copolymer thereof with a non-dye-forming ethylenic monomers which never undergo coupling reaction with an oxidized form of an aromatic primary amine developing agent.

The compounds represented by formula (I) are 5-membered ring/5-membered ring condensed nitrogen-containing heterocyclic couplers and the coupling nucleus thereof exhibits aromaticity electrically equivalent to that of naphthalene. The compounds have a structure known generically as azapentalene. Preferred examples thereof are 1H-imidazo(1,2-b)pyrazoles, 1H-pyrazolo(1,5-b)pyrazoles, 1H-pyrazolo(5,1-c)(1,2,4)triazoles, 1H-pyrazolo(1,5-b)(1,2,4)triazoles, 1H-pyrazolo(1,5-d)tetrazoles and 1H-pyrazolo(1,5-a)benzimidazoles which are respectively represented by the following general formulas (Ia) to (If). Particularly preferred examples are those represented by formulas (Ia), (Ic) and (Id) and more preferably those represented by formula (Id).

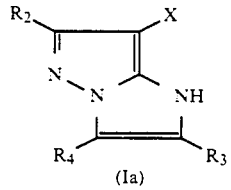

(Ia)

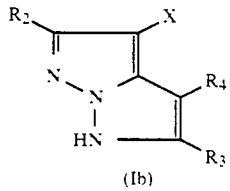

(Ib)

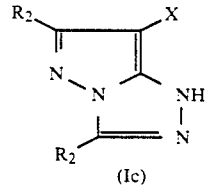

(Ic)

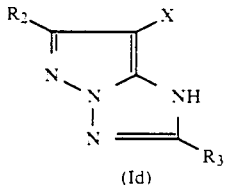

(Id)

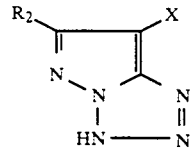

(Ie)

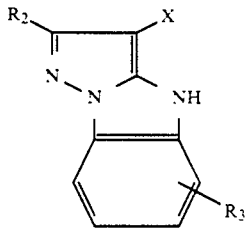

(If)

In the formulas (Ia) to (If), the substituents $R_2$ to $R_4$ may be the same or different and independently represents a hydrogen atom, a halogen atom, an alkyl group, an aryl group, a heterocyclic group, a cyano group, an alkoxy group, an aryloxy group, a heterocycloxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclothio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; X represents a hydrogen atom, a halogen atom, a carbonyl group, or a group which is bonded to the carbon atom at the coupling position through an oxygen, nitrogen or sulfur atom and can be eliminated through the coupling reaction.

$R_2$, $R_3$, $R_4$ or X may be a bivalent group to form bisproducts. Moreover, if the parts represented by formulas (Ia) to (If) are moieties of vinyl monomers, one of $R_2$ to $R_4$ represents a single bond or a linking group through which the vinyl group and moieties (Ia) to (If) are bonded together.

More specifically, $R_2$ to $R_4$ each represents a hydrogen atom, a halogen atom, an alkyl group, an aryl group, a heterocyclic group, a cyano group, an alkoxy group, an aryloxy group, a heterocycloxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclothio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group.

X represents a hydrogen atom, a halogen atom, a carbonyl group, or a group which is bonded to the carbon atom at the coupling position through an oxygen, nitrogen or sulfur atom and can be eliminated through the coupling reaction. Examples of the group bonded to the carbon atom through an oxygen atom include an acetoxy group, a propanoyloxy group, a benzoyloxy group, an alpha-naphthoxy group and a 2-benzothiazolyloxy group; examples of the group bonded to the carbon atom through a nitrogen atom are a benzenesulfonamido group, an N-ethyltoluenesulfonamido group, a 1-benzyl-ethoxy-3-hydantoinyl group and a 2-hydroxy-4-propanoylphenylazo group; and examples of the group bonded to the carbon atom through a sulfur atom include a phenylthio group, a 2-carboxyphenylthio group, a 2-butoxy-5-t-octylphenylthio group, a 4-methanesulfoamidophenylthio group, a benzylthio group and a 2-phenyl-3-dodecyl-1,2,4-triazole-5-thio group.

When $R_2$ to $R_4$ or X is a bivalent group to form bisproducts, more specifically examples of the bivalent groups include a substituted or unsubstituted alkylene or phenylene group and a group: —NHCO—$R_5$—CONH— (wherein $R_5$ represents a substituted or unsubstituted alkylene or phenylene group).

When the moieties represented by formulas (Ia) to (If) are included in the vinyl monomers, examples of the linking group represented by $R_2$, $R_3$ or $R_4$ are those formed by combining the groups selected from the group consisting of substituted or unsubstituted alkylene groups, substituted or unsubstituted phenylene groups, —NHCO—, —CONH—, —O—, —OCO— and aralkylene groups.

The vinyl monomers may have substituents other than those represented by formulas (Ia) to (If). Preferred examples of such substituents include a hydrogen atom, a chlorine atom or a lower alkyl group having 1 to 4 carbon atoms.

Examples of the monomers which do not cause coupling reaction with the oxidized product of an aromatic primary amine developing agent are acrylic acid, alpha-chloroacrylic acid, alpha-alacrylic acid, esters or amides derived from these acrylic acids such as acrylamide, butyl acrylamide, diacetone acrylamide, methacrylamide, methyl acrylate, ethyl acrylate, butyl acrylate and beta-hydroxymethacrylate; methylene dibisacrylamide, vinyl esters such as vinyl acetate, vinyl propionate and vinyl laurate; acrylonitrile, methacrylonitrile, aromatic vinyl compounds such as styrene and derivatives thereof, vinyl toluene, divinyl benzene, vinyl acetophenone and sulfostyrene; itaconic acid, citraconic acid, crotonic acid, vinylidene chloride, vinyl alkyl ethers such as vinyl ethyl ether, maleic acid, maleic anhydride, maleates, N-vinyl-2-pyrrolidone, N-vinylpyridine, and 2- and 4-vinylpyridine. These non-dye-forming ethylenically unsaturated monomers may be used alone or in combination.

Examples of the couplers represented by formulas (Ia) to (If) and methods for preparing these are disclosed in the following articles:

Compounds (Ia) are disclosed in, for instance, J.P. KOKAI No. 59-162548; compounds (Ib) in J.P. KOKAI No. 60-43659; compounds (Ic) in J.P. KOKOKU No. 47-27411; compounds (Id) in J.P. KOKAI Nos. 59-171956 and 60-172982; compounds (Ie) in J.P. KOKAI No. 60-33552; and compounds (If) in U.S. Pat. No. 3,061,432.

The ballast groups exhibiting high coloring properties disclosed in J.P. KOKAI Nos. 58-42045, 59-214854, 59-177553, 59-177544 and 59-177557 may be applied to any of compounds (Ia) to (If).

Specific examples of pyrazoloazole type couplers will be given below, but the present invention is not restricted to these specific examples.

M-1

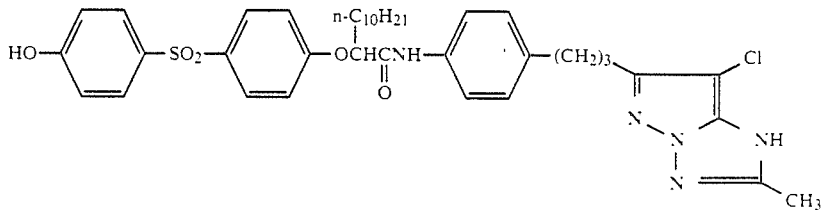

-continued
M-2
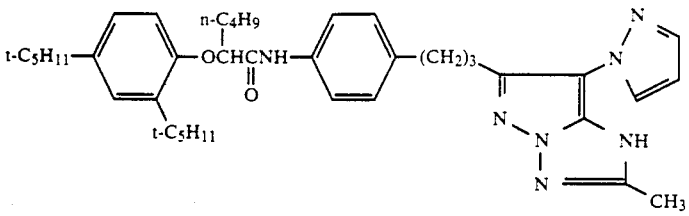
M-3
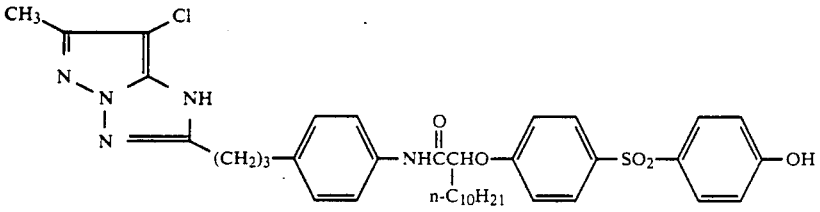
M-4
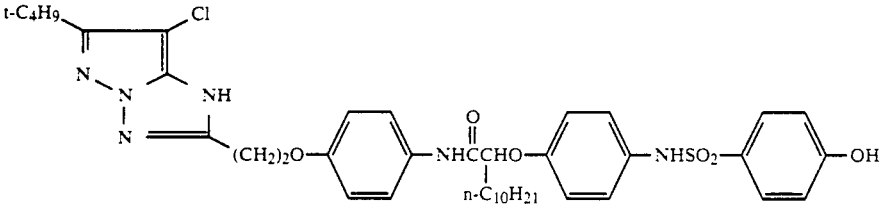
M-5
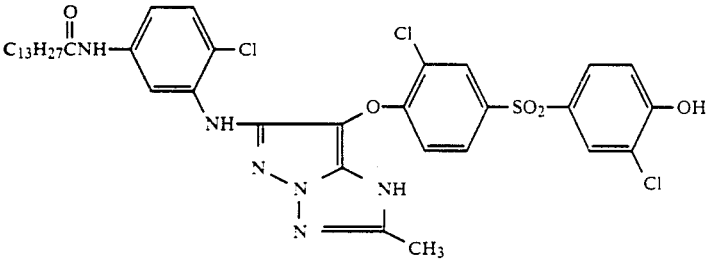
M-6
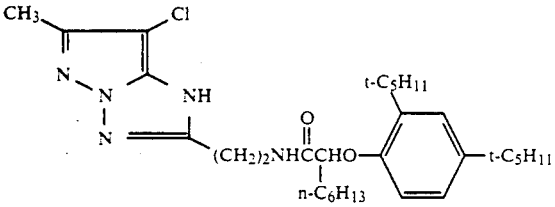
M-7
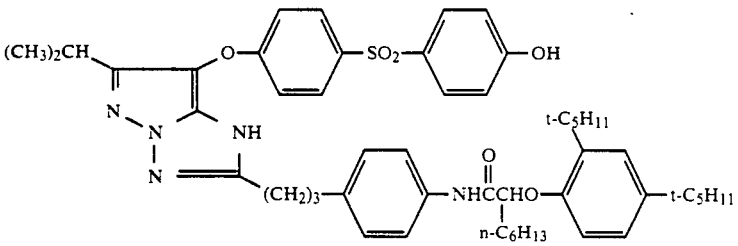
M-8
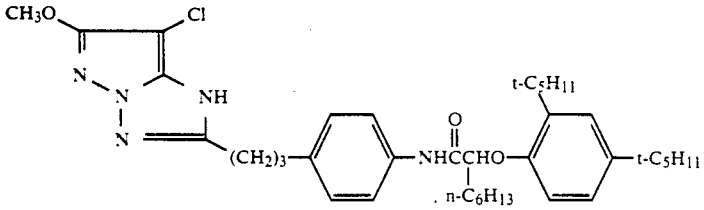

-continued
M-9
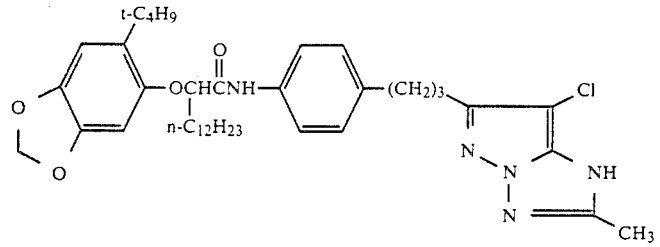
M-10
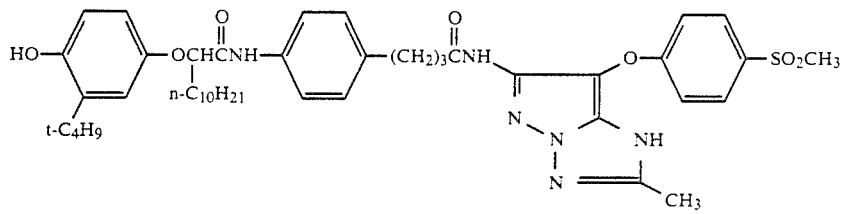
M-11
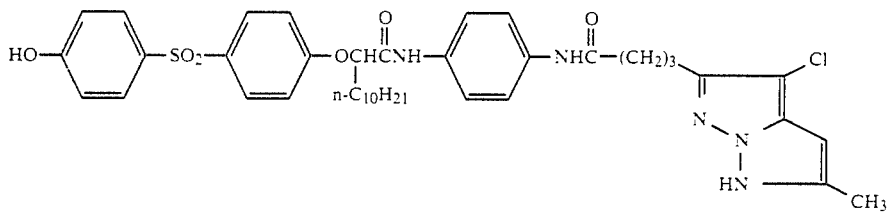
M-12
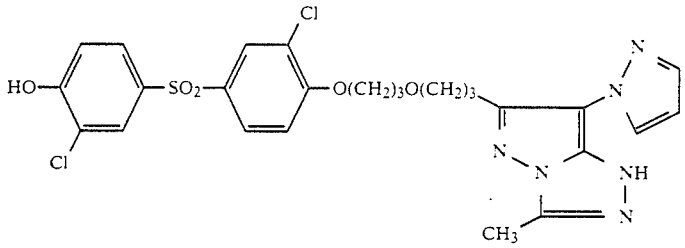
M-13
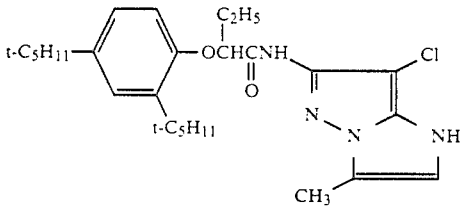
M-14
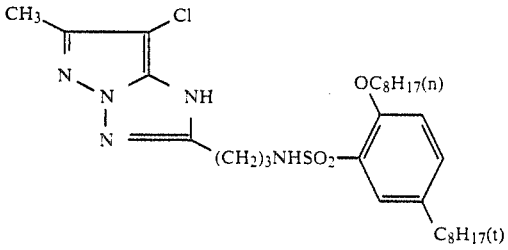
M-15
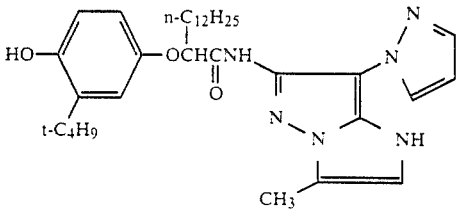

-continued
M-16
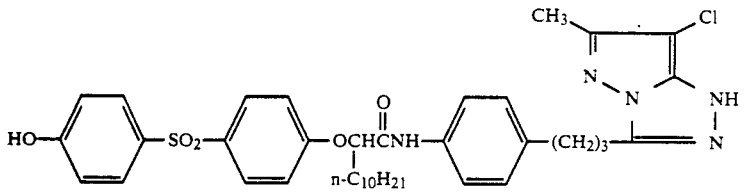
M-17
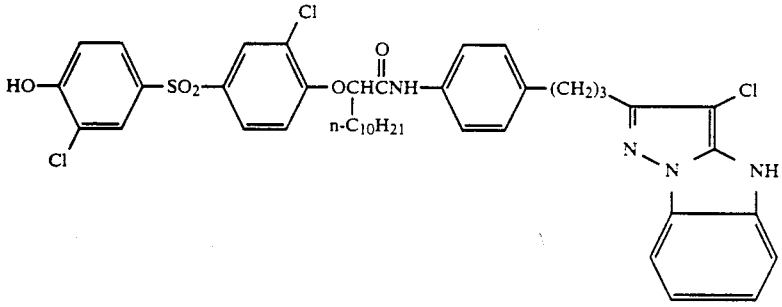
M-18
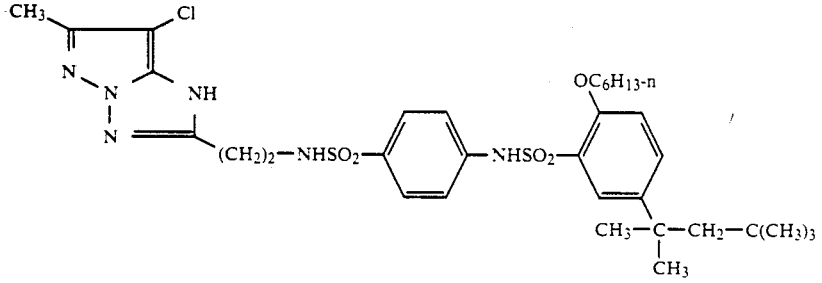
M-19
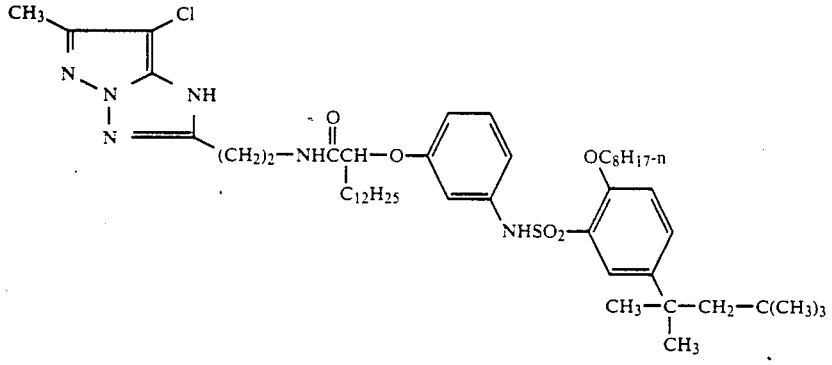
M-20
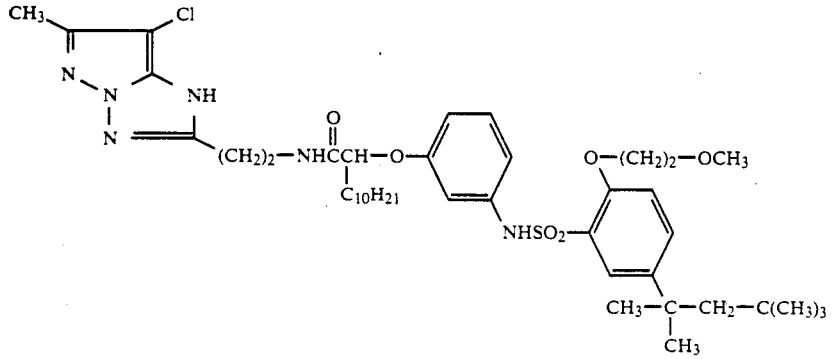

-continued
M-21
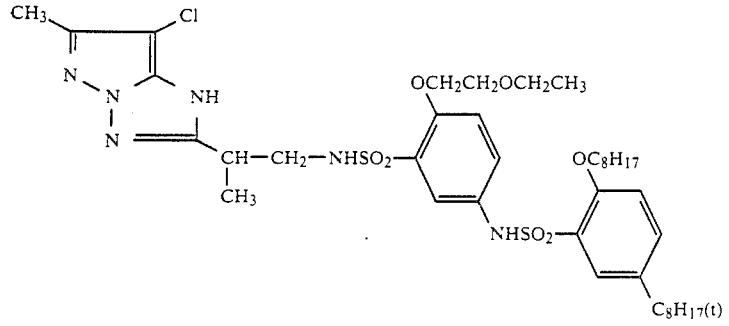
M-22
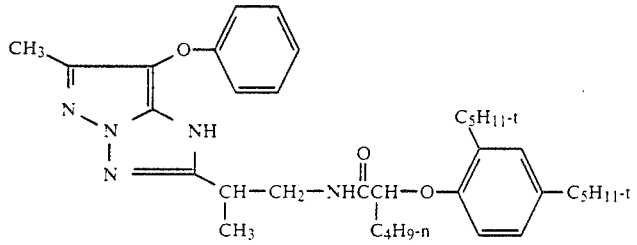
M-23
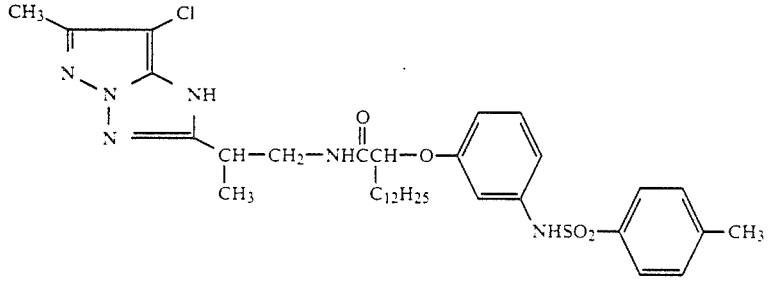
M-24
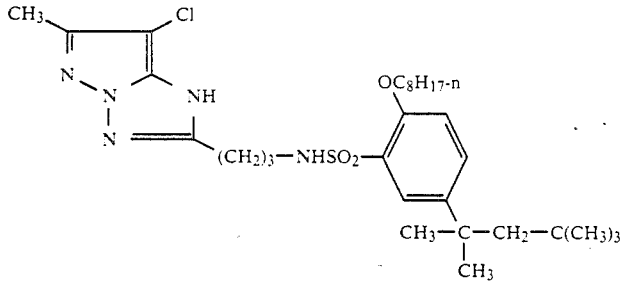
M-25
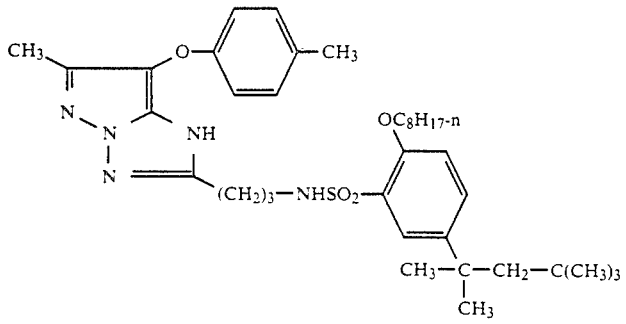

-continued
M-26
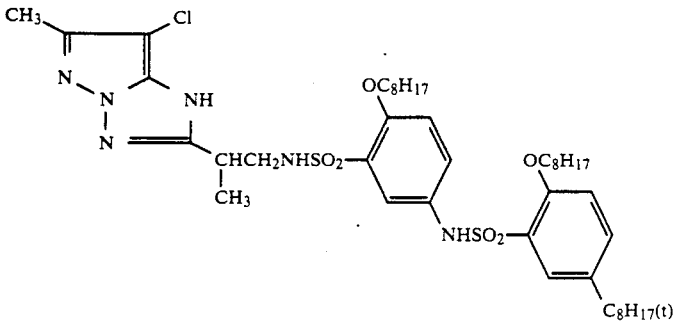
M-27
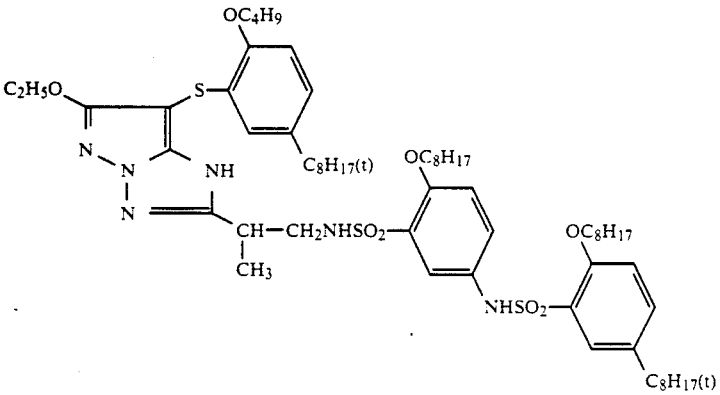
M-28
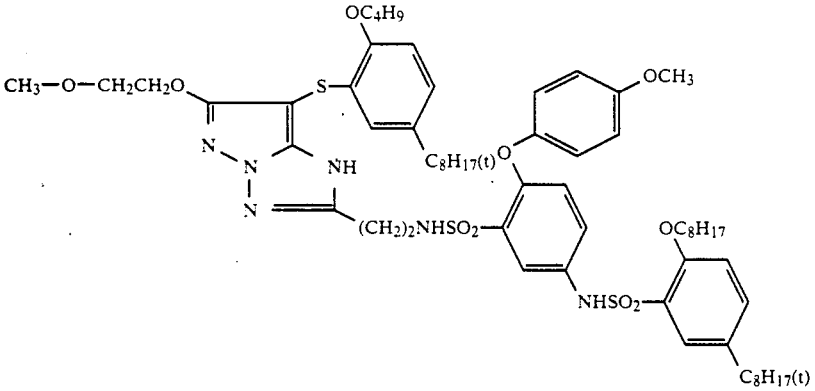
M-29
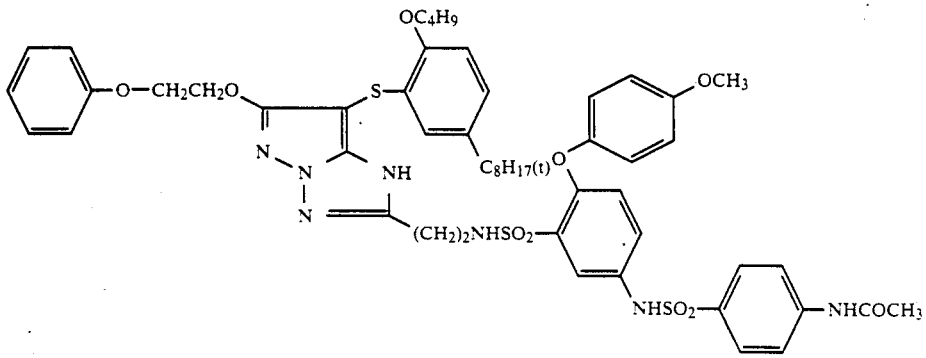

-continued
M-30
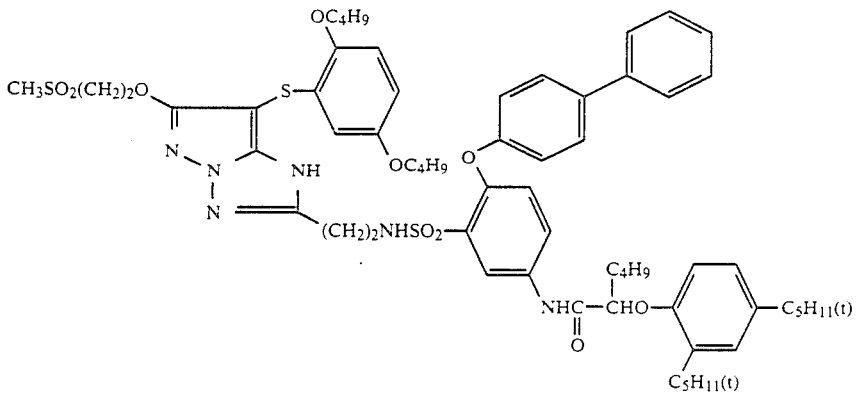
M-31
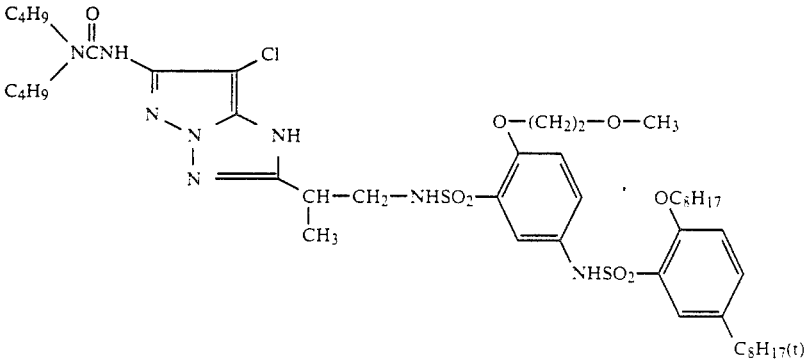
M-32
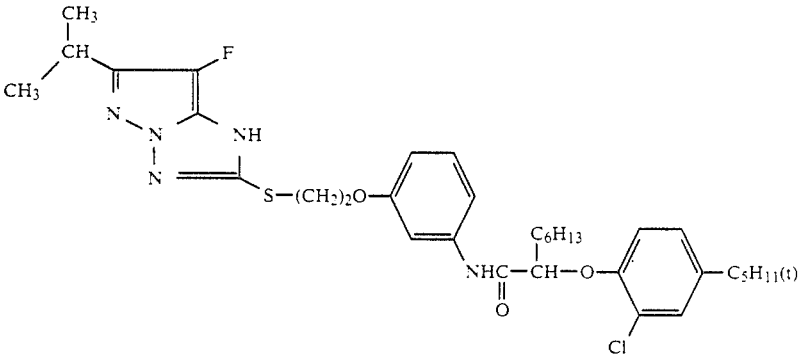
M-33
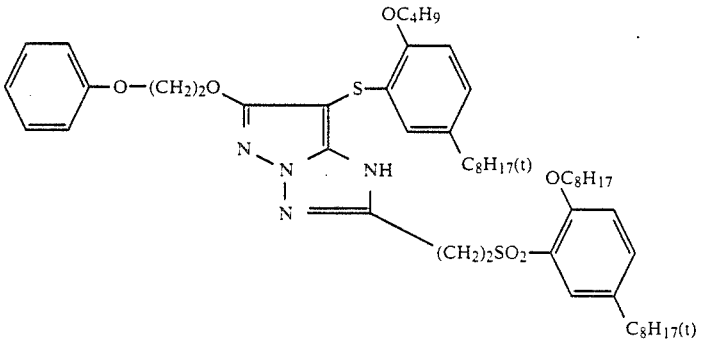
M-34
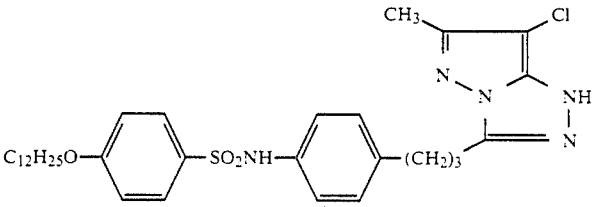

-continued
M-35
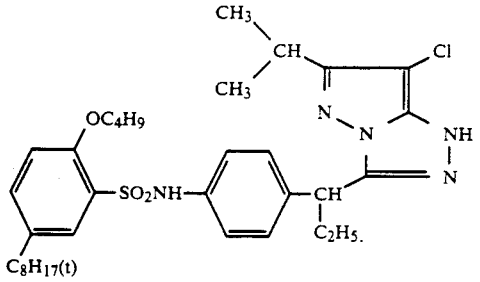
M-36
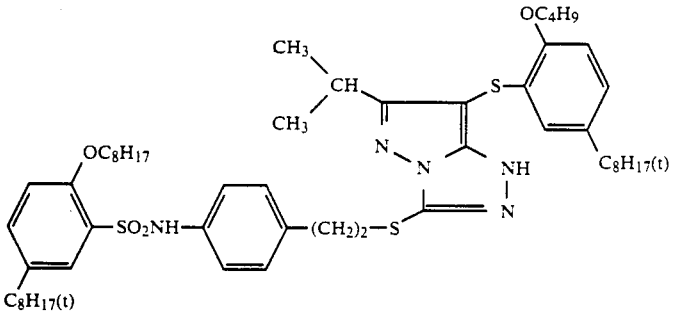
M-37
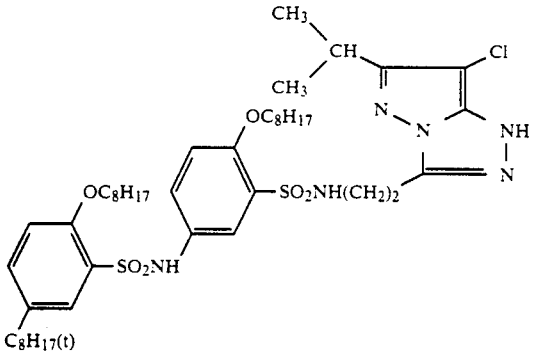
M-38
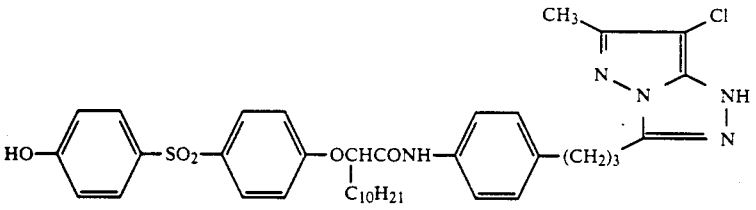
M-39
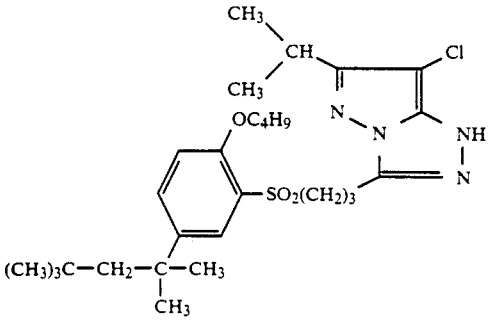

-continued
M-40
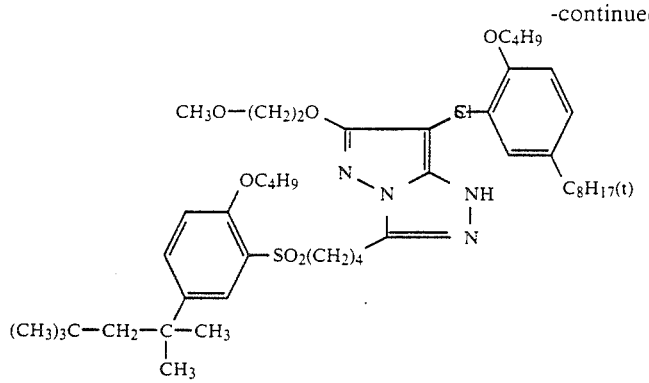
M-41
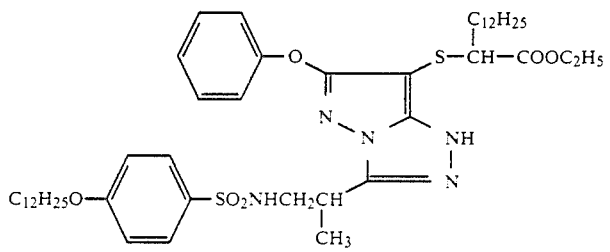
M-42
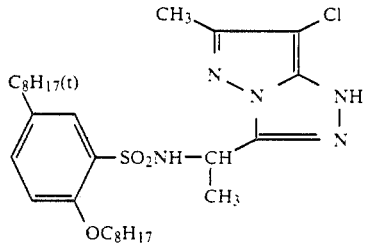
M-43
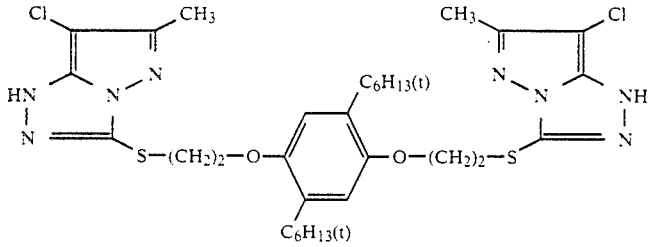
M-44
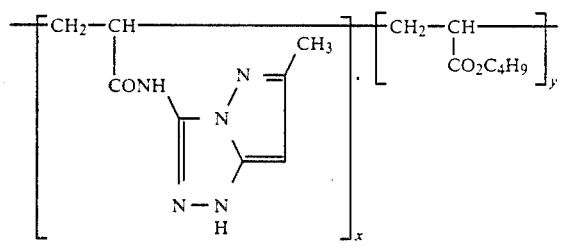
x:y = 50:50 (weight ratio)
M-45
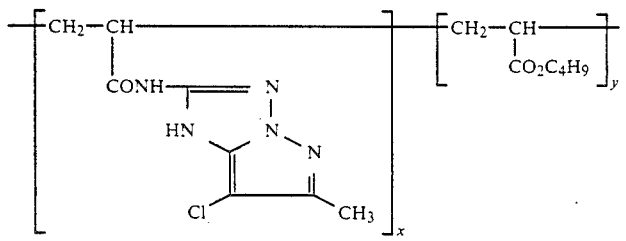
x:y = 50:50 (weight ratio)

-continued

M-46

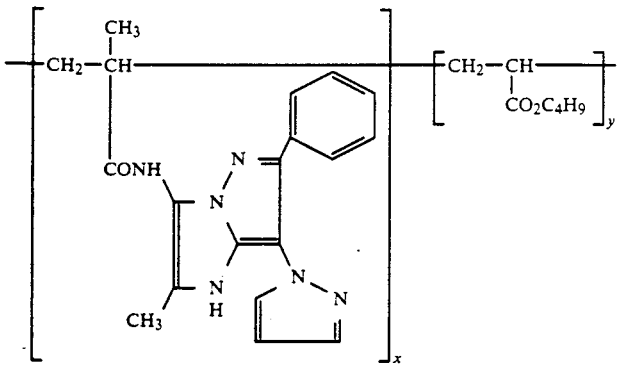

x:y = 50:50 (weight ratio)

The compounds represented by formula (I) are detailed in J.P. KOKAI No. 62-30250 (p. 2-6) and examples thereof are also described therein (p. 7-15) which can be used in the present invention.

In formula (II), Ar represents an optionally substituted phenyl group; Y represents a group which is eliminated through coupling reaction with an oxidized form of an aromatic primary amine developing agent; V is a halogen atom, an alkoxy group or an alkyl group; R represents a group capable of being substituted on the benzene ring; and n is an integer of 1 or 2 provided that if n is 2, the groups R may be the same or different.

The magenta couplers represented by formula (II) usuable in the invention will be detailed below.

First, each group Ar, Y, V or R will be specifically be explained hereinunder.

Ar: This is a phenyl group, particularly a substituted phenyl group. Examples of the substituents of the phenyl group are halogen atoms, alkyl groups, alkoxy groups, aryloxy groups, alkoxycarbonyl groups, a cyano group, a carbamoyl group, a sulfamoyl group, a sulfonyl group, a sulfonamido group, and/or an acylamino group. The phenyl group may have two or more of these substituents. Preferred are halogen atoms, particularly chlorine atoms.

Y: This represents a group which is eliminated when the compound is coupled with an oxidized form of an aromatic primary amine developing agent to form a dye and specifically represents a halogen atom, an alkoxy group, an aryloxy group, an acyloxy group, an arylthio group, an alkylthio group and a group (a):

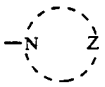

(wherein Z represents an atomic group which is needed to form a 5- or 6-membered ring together with the nitrogen atom and an atom selected from the group consisting of carbon, oxygen, nitrogen and sulfur atoms). Examples of the group (a) include a pyrazolyl group, an imidazolyl group, triazolyl group and tetrazolyl group. Particularly preferred Y is a group capable of being eliminated at S.

V: This represents a halogen atom, an alkoxy group or an alkyl group. Preferred are halogen atoms and particularly a chlorine atom.

R: This represents a group which may be substituted on the benzene ring an n is an integer of 1 or 2. If n is 2, the groups R may be the same or different. Examples of R are halogen atoms, R'—, R'O—, R'CO—NR''—, R'SO $_2$—NR''—, R''O—CO—NR''—, R'COO—, R'—NR''—CO—, R'—NR''—$SO_2$—, R'O—CO—, R'—NR''—CO—NR'''—or a group (b):

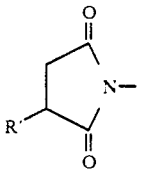

wherein R', R'' and R''' may be the same or different and each represents a hydrogen atom or an alkyl, alkenyl or aryl group optionally having substituents. Preferred are R'CONH—, R'$SO_2$NH— and the group (b).

The magenta couplers usable in the present invention will be listed below, but the invention is not restricted to the following specific examples.

m-1

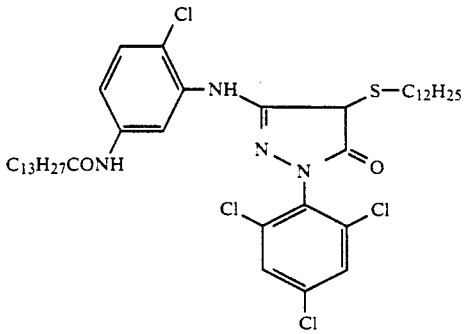

-continued
m-2
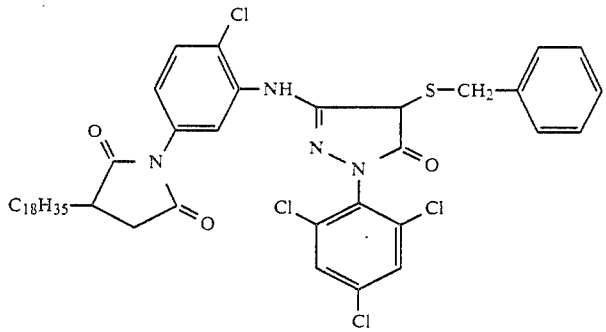
m-3
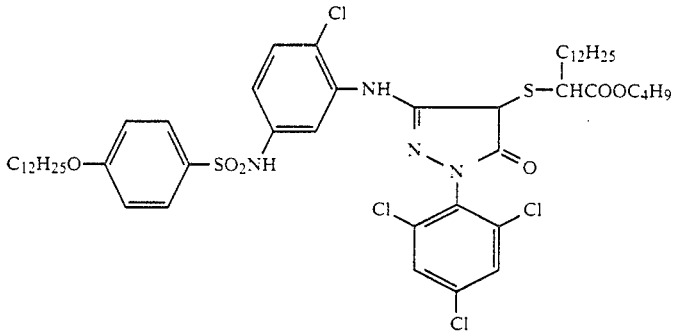
m-4
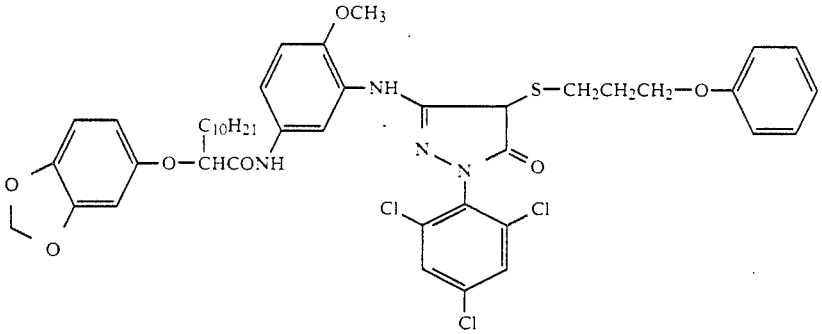
m-5
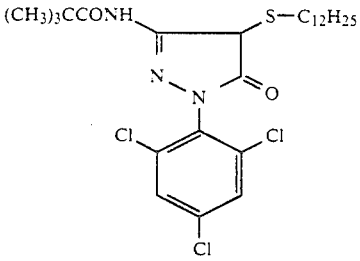
m-6
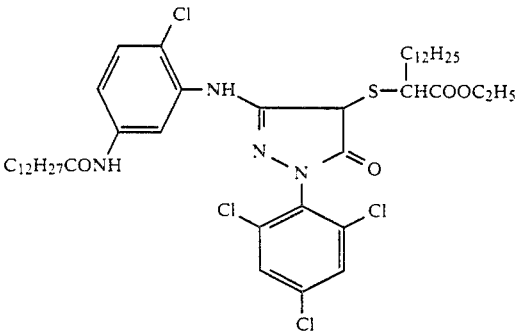

-continued
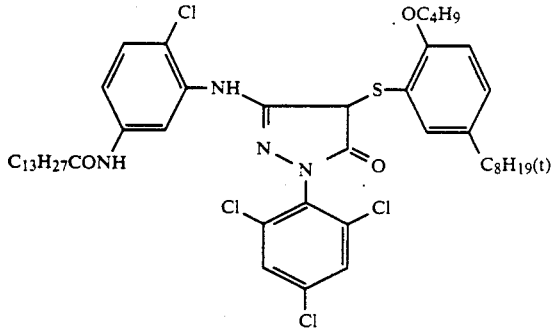
m-7
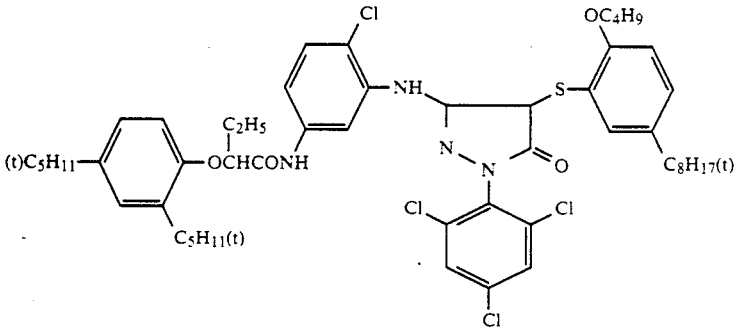
m-8
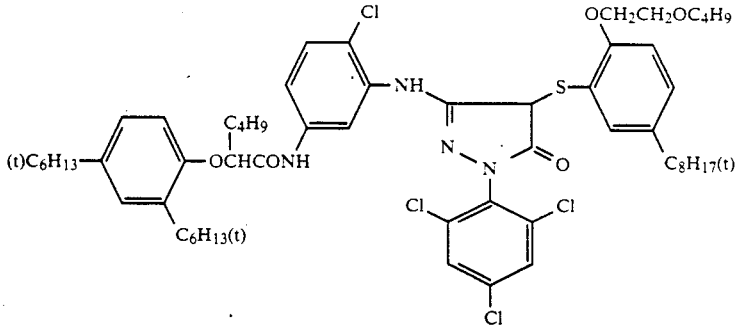
m-9
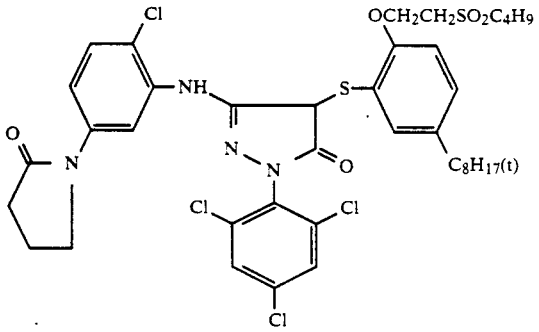
m-10

-continued
m-11
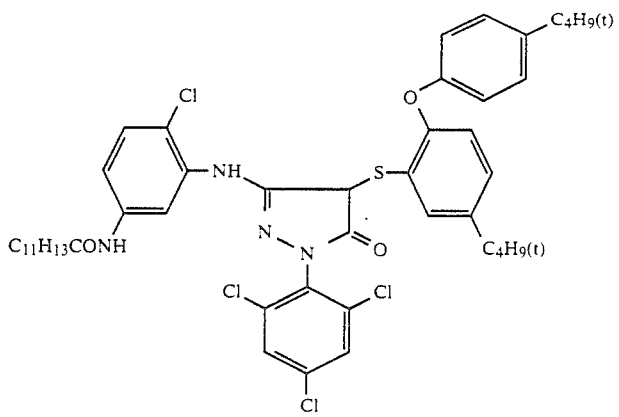
m-12
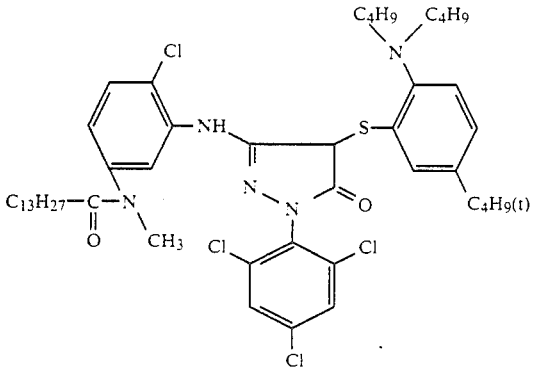
m-13
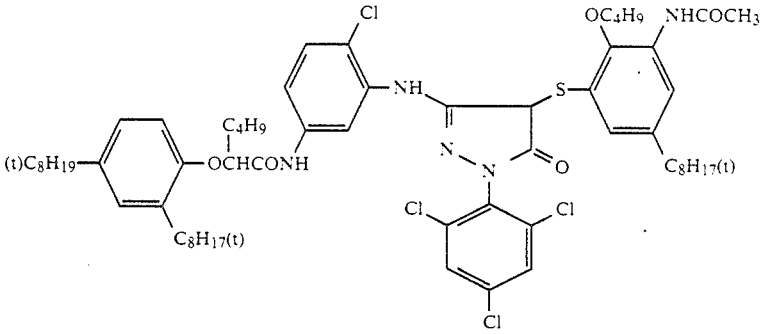
m-14
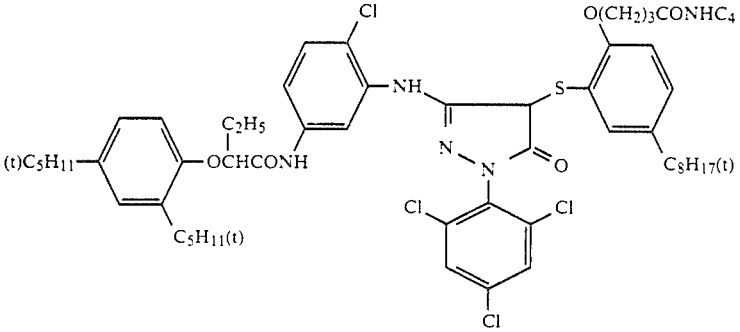

-continued
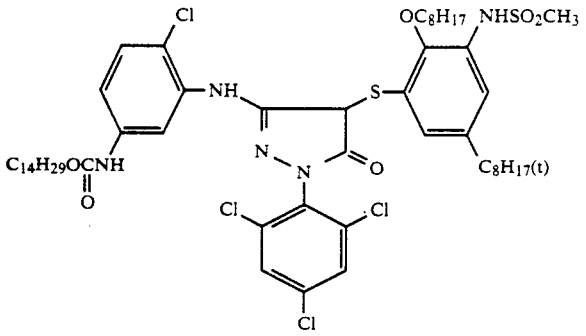
m-15
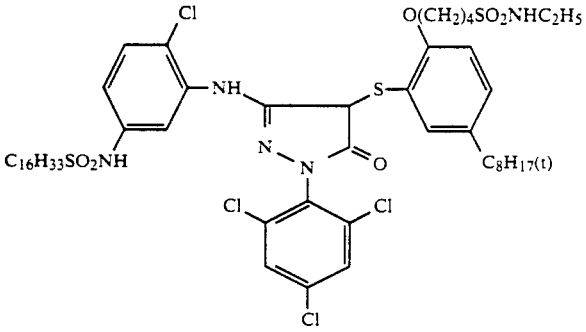
m-16
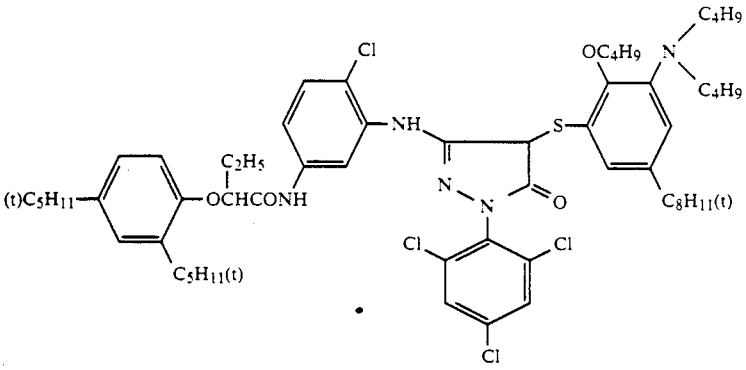
m-17
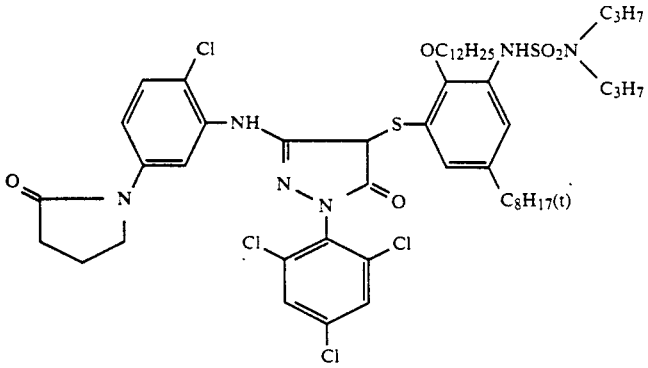
m-18

-continued
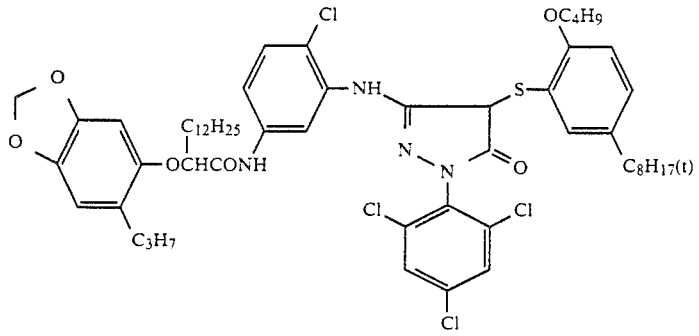
m-19
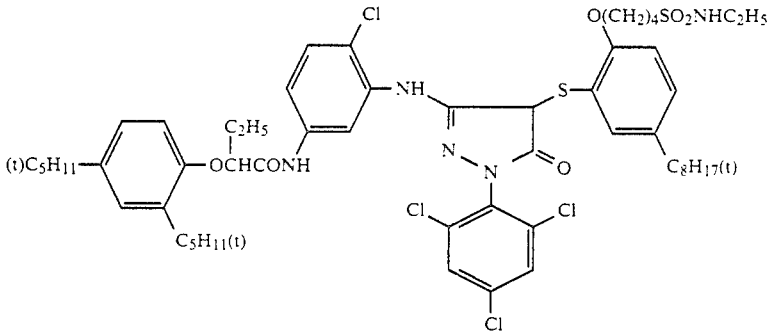
m-20
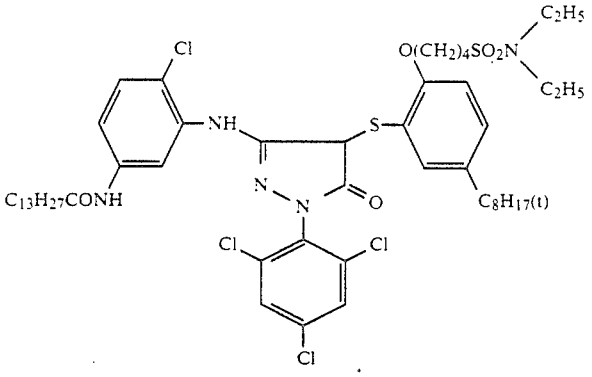
m-21
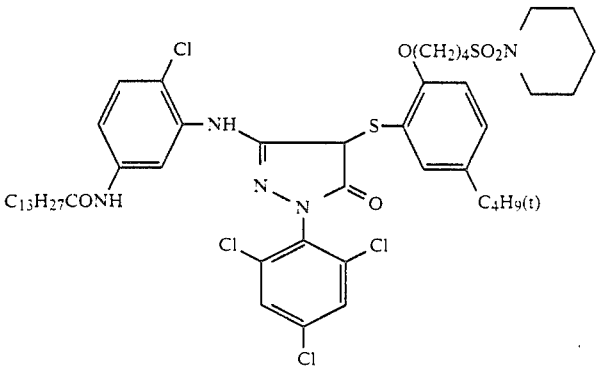
m-22

-continued
m-23
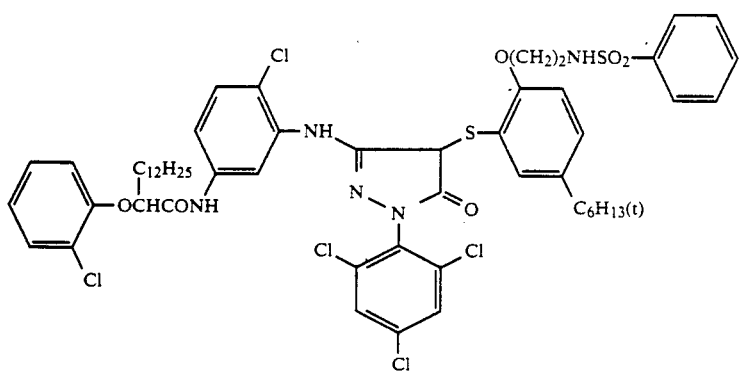
m-24
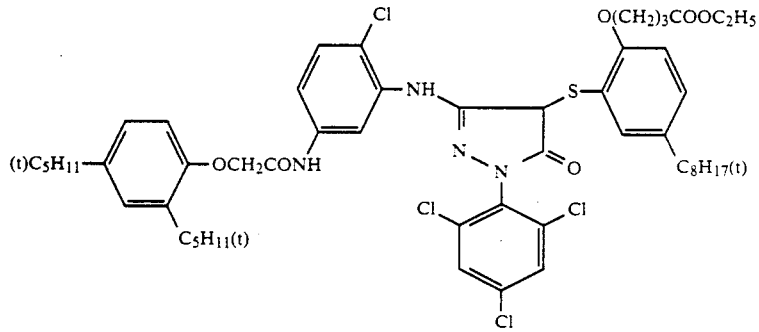
m-25
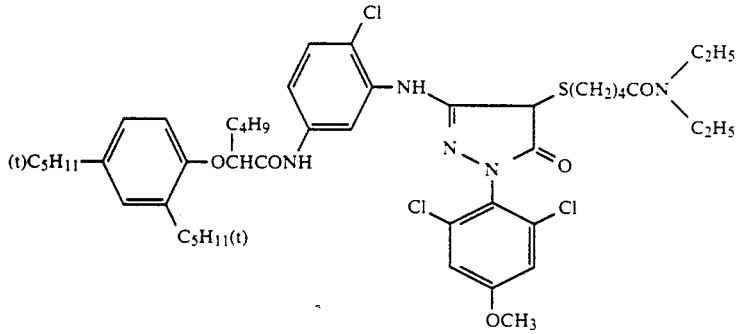
m-26
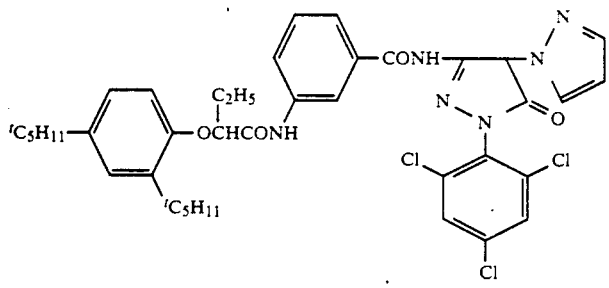
m-27
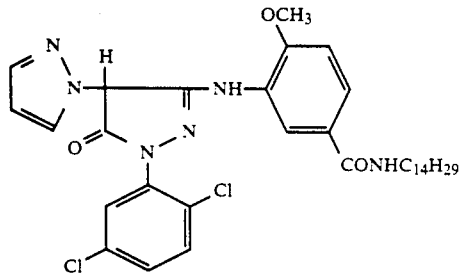

-continued
m-28
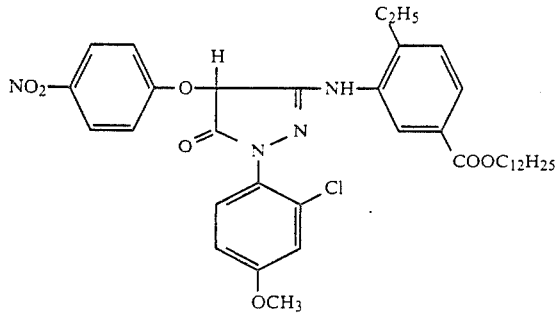
m-29
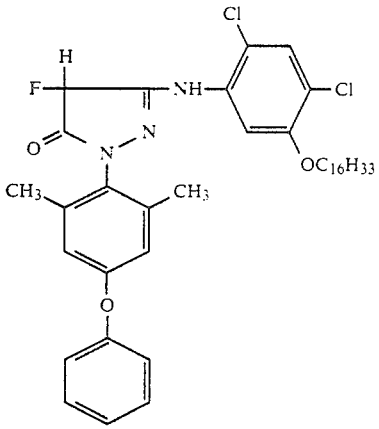
m-30
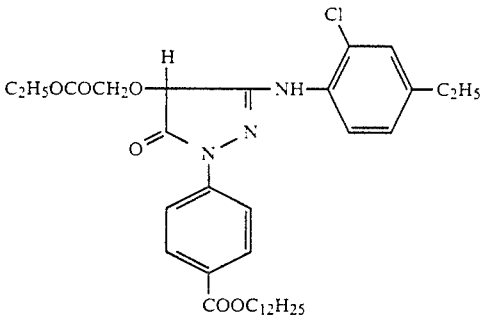
m-31
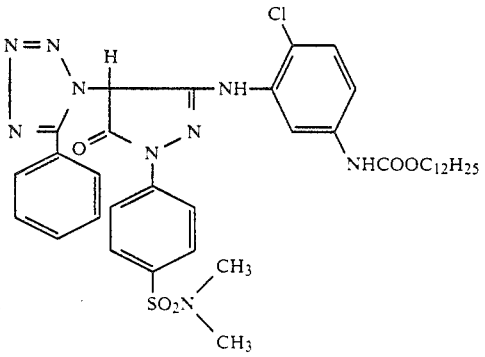

-continued m-32

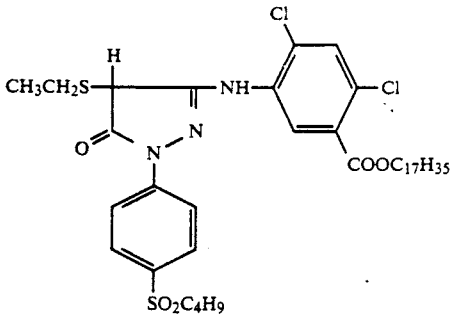

The compounds represented by formula (II) used in the invention are detailed in J. P. KOKAI Nos. 60-262161 (p. 3-7) and 60-238832 (p. 6-7) and examples thereof usable in the invention are disclosed in J.P. KOKAI Nos. 60-262161 (p. 7-11) and 60-238832 (p. 7-9).

The magneta couplers usable in the invention can be prepared by the methods described in, for instance, J. P. KOKOKU No. 53-34044, J. P. KOKAI No. 55-62454 and U.S. Pat. No. 3,701,783.

Cyan couplers usable in the present invention include naphtholic or phenolic couplers of an oil protect type.

Typical examples fo naphthol type couplers are disclosed in U.S. Pat. No. 2,474,293. Typical preferred 2-equivalent naphtolic couplers of oxygen atom elimination type are disclosed in U.S. Pat. Nos. 4,052,212; 4,146,396; 4,228,233; and 4,296,200. Exemplary phenol type couplers are those disclosed in U.S. Pat. Nos. 2,369,929; 2,801,171; 2,772,162 and 2,895,826.

Cyan couplers resistant to humidity and heat are preferably used in the invention. Examples of such couplers are phenol type cyan couplers having an alkyl group having not less than 2 carbon atoms at a metha-position of a phenolic nucleus as described in U.S. Pat. No. 3,772,002; 2,5-diacylamino-substituted phenol type couplers as disclosed in U.S. Pat. Nos. 2,772,162; 3,758,308; 4,126,396; 4,334,011 and 4,327,173; DEOS No. 3,329,729; and J. P. KOKAI No. 59-166956; and phenol type couplers having a phenylureido group at 2-position and an acylamino group at 5-position of the phenol nucleus as disclosed in U.S. Pat. Nos. 3,446,622; 4,333,999; 4,451,559 and 4,427,767.

Graininess may be improved by using together a coupler which can form a dye having a moderate diffusibility. As such dye-forming couplers, some magenta couplers are specifically disclosed in U.S. Pat. No. 4,336,237 and U.K. Patent No. 2,125,570 and some yellow, magenta and cyan couplers are specifically disclosed in European Patent No. 96,570 and DEOS No. 3,234,533.

Dye-forming couplers and aforementioned special couplers may be a dimer or a higher polymer. Typical examples of such polymerized dye-forming couplers are disclosed in U.S. Pat. Nos. 3,451;820 and 4,080,211. Examples of such polymerized magenta couplers are described in U. K. Patent No. 2,102,173 and U.S. Pat. No. 4,367,282.

In the present invention, at least two such couplers may be added to a single layer or one such coupler may be added to two or more different layers to impart desired properties to the color light-sensitive materials.

The couplers used in the invention can be introduced, into the color light-sensitive materials, by a variety of known methods for dispersion. Examples of high boiling point organic solvents used in the oil-in-water dispersion method are disclosed in U.S. Pat. No. 2,322,027. Specific examples of processes, effects and latexes for impregnation for latex dispersion method are, for instance, disclosed in U.S. Pat. No. 4,199,363 and DE OLS Nos. 2,541,274 and 2,541,230.

The standard amount of the color couplers is 0.001 to 1 mole per mole of light-sensitive silver halide and preferably 0.01 to 0.5 moles for yellow couplers, 0.003 to 0.3 moles for magenta couplers and 0.002 to 0.3 moles for cyan couplers.

Substrates for color light-sensitive materials having a silver iodide content of not less than 2 mole % are, for instance, plastic films of such as cellulose nitrate, cellulose acetate, and polyethylene terephthalate while those for color light-sensitive materials substantially free from silver iodide are, for instance, flexible substrates such as paper or reflecting substrates composed of a flexible substrate on which a film of the foregoing plastic is coated. These substrates and the method for coating thereof are detailed in Research Disclosure, Vol. 176, No. 17643, Item XV (p.27) and XVII (p.28) (December, 1978).

The "reflecting substrates" herein means a substrate having improved reflective power and makes the dye images formed on silver halide emulsion layer clear. Examples of such substrates include those covered with a hydrophobic resin film including a reflective material dispersed therein, such as titanium oxide, zinc oxide, calcium carbonate and calcium sulfate and those composed of such a hydrophobic resin including a dispersed reflective material.

Figure 2:
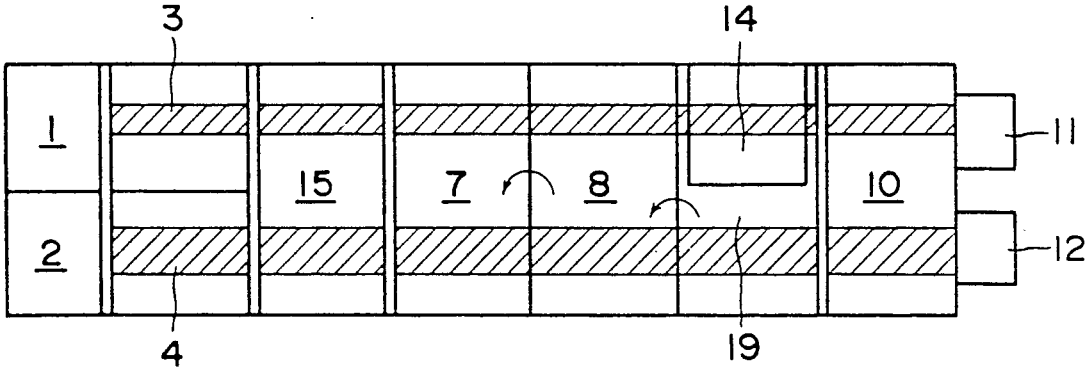
Figure 3:
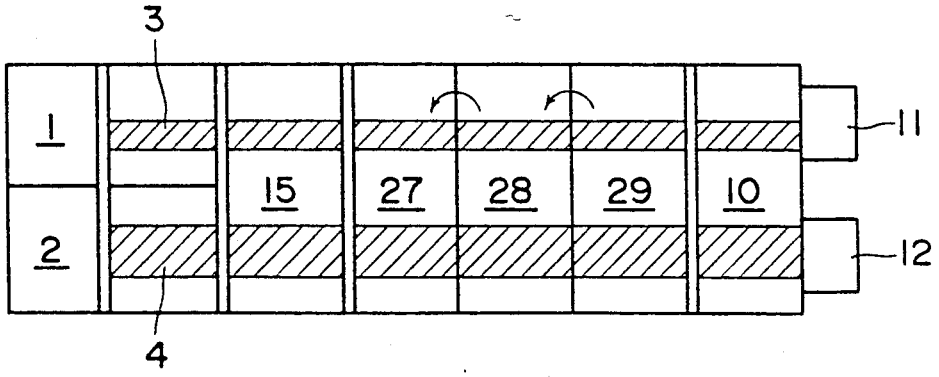

The processing method of the present invention can be carried out by using an automatic developing machine such as those shown in FIGS. 1 to 3. In these figures, reference numerals are as follows: 1—inlet for color negative film; 2—inlet for color paper; 3—developing bath for coloe negative film; 4—developing bath for color paper; 5—bleaching bath (common); 6—fixing bath (common); 7, 27—water washing bath (1) (common); 8, 28—water washing bath (2) (common); 9, 29—water washing bath (3) (common); 10—drying zone; 11—recovery zone for color negative film; 12—recovery zone for color paper; 14—stabilization bath; 15—bleach-fixing bath; and 19—water washing bath.

As discussed above in detail, the method for processing color light-sensitive materials of the present invention makes it possible to process, in the same processing bath(s), color light-sensitive materials for taking photographs such as color negative films and those for print such as color paper. As a result, these color light-sensitive materials differing in their silver iodide contents can be processed in only one automatic developing machine which in turn leads to the substantial reduction in space for installing the machine.

Moreover, since the same processing solution(s) can be used for processing different light-sensitive materials, the number of processing solutions to be prepared are minimized. In addition, if this technique is combined with replenisher-saving processing, the amount of waste liquor is greatly reduced and the operations therefor can be simplified.

The processing method of the present invention can be applied to not only the processing of color paper and color negative films but also the processing of other various color light-sensitive materials such as the combination of color reversal films and color reversal paper; color autopositive paper and color autopositive films, which are simply listed by way of examples.

The present invention will hereunder be described in more specifically with reference to the following non-limitative working Examples. In addition, the effects of the invention practically achieved will also be discussed in comparison with Comparative Examples.

EXAMPLE 1

A multilayered color light-sensitive material (Sample A) was prepared by applying in order coating solutions on the surface of a substrate of cellulose triacetate to which an underlying layer had been applied.

Composition of the Light-sensitive Layer

In the following composition, the coated amounts are expressed in g/m$^2$ of elemental silver for silver halide and colloidal silver; in g/m$^2$ for couplers, additives and gelatin; and in moles per mole of silver halide included in the same layer for sensitizing dyes.

| | |
|---|---|
| 1st Layer: Halation Inhibiting Layer | |
| Black colloidal silver | 0.2 |
| Gelatin | 1.3 |
| Coupler C-1 | 0.06 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |
| 2nd Layer: Intermediate Layer | |
| Fine grain silver bromide (average grain size = 0.07 micron) | 0.15 |
| Gelatin | 1.0 |
| Coupler C-2 | 0.02 |
| Dispersion oil Oil-1 | 0.1 |
| 3rd Layer: First Red-sensitive Emulsion Layer | |
| Silver iodobromide emulsion (AgI = 2 mole %; diameter/thickness ratio = 2.5; average grain size = 0.3 micron; AgI content is high at the inner portion) | 0.4 (Ag) |
| Gelatin | 0.6 |
| Sensitizing dye I | $1.0 \times 10^{-4}$ |
| Sensitizing dye II | $3.0 \times 10^{-4}$ |
| Sensitizing dye III | $1.0 \times 10^{-5}$ |
| Coupler C-3 | 0.06 |
| Coupler C-4 | 0.06 |
| Coupler C-8 | 0.04 |
| Coupler C-2 | 0.03 |
| Dispersion oil Oil-1 | 0.03 |
| Dispersion oil Oil-3 | 0.012 |
| 4th Layer: Second Red-sensitive Emulsion Layer | |
| Silver iodobromide emulsion (AgI = 5 mole %, diameter/thickness ratio = 4.0; average grain size = 0.7 micron; AgI content is high at the inner portion) | 0.7 (Ag) |
| Gelatin | 1.0 |
| Sensitizing dye I | $1.0 \times 10^{-4}$ |
| Sensitizing dye II | $3.0 \times 10^{-4}$ |

-continued

| | |
|---|---|
| Sensitizing dye III | $1.0 \times 10^{-5}$ |
| Coupler C-3 | 0.24 |
| Coupler C-4 | 0.24 |
| Coupler C-8 | 0.04 |
| Coupler C-2 | 0.04 |
| Dispersion oil Oil-1 | 0.15 |
| Dispersion oil Oil-3 | 0.02 |
| 5th Layer: Third Red-sensitive Emulsion Layer | |
| Silver iodobromide emulsion (AgI = 10 mole %; diameter/thickness ratio = 1.3; average grain size = 0.8 micron; AgI content is high at the inner portion) | 1.0 (Ag) |
| Gelatin | 1.0 |
| Sensitizing dye I | $1.0 \times 10^{-4}$ |
| Sensitizing dye II | $3.0 \times 10^{-4}$ |
| Sensitizing dye III | $1.0 \times 10^{-5}$ |
| Coupler C-6 | 0.05 |
| Coupler C-7 | 0.1 |
| Dispersion oil Oil-1 | 0.01 |
| Dispersion oil Oil-2 | 0.05 |
| 6th Layer: Intermediate Layer | |
| Gelatin | 1.0 |
| Compound Cpd-A | 0.03 |
| Dispersion oil Oil-1 | 0.05 |
| 7th Layer: First Green-sensitive Emulsion Layer | |
| Silver iodobromide emulsion (AgI = 2 mole %; diameter/thickness ratio = 2.5; average grain size = 0.3 micron; AgI content is high at the inner portion) | 0.3 (Ag) |
| Gelatin | 1.0 |
| Sensitizing dye IV | $5 \times 10^{-4}$ |
| Sensitizing dye VI | $0.3 \times 10^{-4}$ |
| Sensitizing dye V | $2 \times 10^{-4}$ |
| Coupler C-9 | 0.2 |
| Coupler C-5 | 0.02 |
| Coupler C-1 | 0.03 |
| Compound Cpd-C | 0.012 |
| Dispersion oil Oil-1 | 0.5 |
| 8th Layer: Second Green-sensitive Emulsion Layer | |
| Silver iodobromide emulsion (AgI = 4 mole %; diameter/thickness ratio = 4.0; average grain size = 0.6 micron; AgI content is high at the inner portion) | 0.4 (Ag) |
| Gelatin | 1.0 |
| Sensitizing dye IV | $5 \times 10^{-4}$ |
| Sensitizing dye VI | $0.3 \times 10^{-4}$ |
| Sensitizing dye V | $2 \times 10^{-4}$ |
| Coupler C-9 | 0.25 |
| Coupler C-1 | 0.03 |
| Coupler C-10 | 0.015 |
| Coupler C-5 | 0.01 |
| Compound Cpd-C | 0.012 |
| Dispersion oil Oil-1 | 0.2 |
| 9th Layer: Third Green-sensitive Emulsion Layer | |
| Silver iodobromide emulsion (AgI = 6 mole %; diameter/thickness ratio = 1.2; average grain size = 1.0 micron; AgI content is high at the inner portion) | 0.85 (Ag) |
| Gelatin | 1.0 |
| Sensitizing dye VII | $3.5 \times 10^{-4}$ |
| Sensitizing dye VIII | $1.4 \times 10^{-4}$ |
| Coupler C-13 | 0.01 |
| Coupler C-12 | 0.03 |
| Coupler C-9 | 0.20 |
| Coupler C-1 | 0.02 |
| Coupler C-15 | 0.02 |
| Dispersion oil Oil-1 | 0.20 |
| Dispersion oil Oil-2 | 0.05 |
| 10th Layer: Yellow Filter Layer | |
| Gelatin | 1.2 |
| Yellow colloidal silver | 0.08 |
| Compound Cpd-B | 0.1 |
| Dispersion oil Oil-1 | 0.3 |
| 11th Layer: First Blue-sensitive Layer | |
| Silver iodobromide emulsion (AgI = 4 mole %; diameter/thickness ratio = 1.5; average grain size = 0.5 micron; AgI content is high at the inner portion) | 0.4 (Ag) |
| Gelatin | 1.0 |
| Sensitizing dye IX | $2 \times 10^{-4}$ |

-continued

| | |
|---|---|
| Coupler C-14 | 0.9 |
| Coupler C-5 | 0.07 |
| Dispersion oil Oil-1 | 0.2 |
| 12th Layer: Second Blue-sensitive Layer | |
| Silver iodobromide emulsion (AgI = 10 mole %; diameter/thickness ratio = 4.5; average grain size = 1.3 micron; AgI content is high at the inner portion) | 0.4 (Ag) |
| Gelatin | 0.6 |
| Sensitizing dye IX | $1 \times 10^{-4}$ |
| Coupler C-14 | 0.25 |
| Dispersion oil Oil-1 | 0.07 |
| 13th Layer: First Protective Layer | |
| Gelatin | 0.8 |
| Ultraviolet absorber UV-1 | 0.1 |
| Ultraviolet absorber UV-2 | 0.2 |
| Dispersion oil Oil-1 | 0.01 |

-continued

| | |
|---|---|
| Dispersion oil Oil-2 | 0.01 |
| 14th Layer: Second Protective Layer | |
| Fine grain silber bromide (average grain size = 0.07 micron) | 0.5 |
| Gelatin | 0.45 |
| Polymethylmethacrylate particles (diameter = 1.5 micron) | 0.2 |
| Film hardening agent H-1 | 0.4 |
| n-Butyl p-hydroxybenzoate | 0.012 |
| Formaldehyde scavenger S-1 | 0.5 |
| Formaldehyde scavenger S-2 | 0.5 |

To each layer there was added a surfactant as a coating aid in addition to the foregoing components.

The chemical structures and the chemical names of the compounds used in this Example are as follows:

UV-1

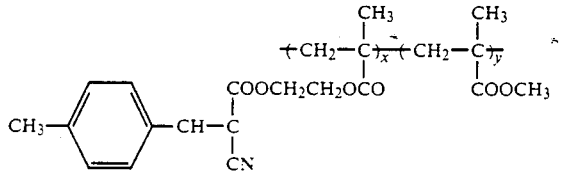

x/y = 7/3 (weight ratio)

UV-2

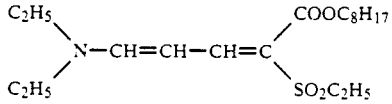

Oil-1: Tricresyl Phosphate

Oil-2: Dibutyl Phthalate

Oil-3: Bis(2-ethylhexyl) Phthalate

C-1

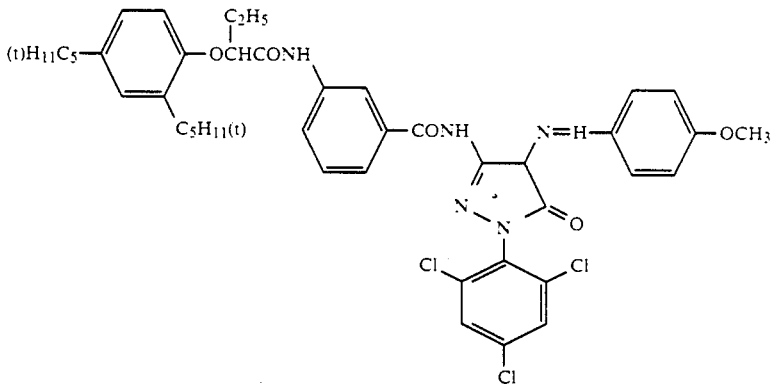

C-2

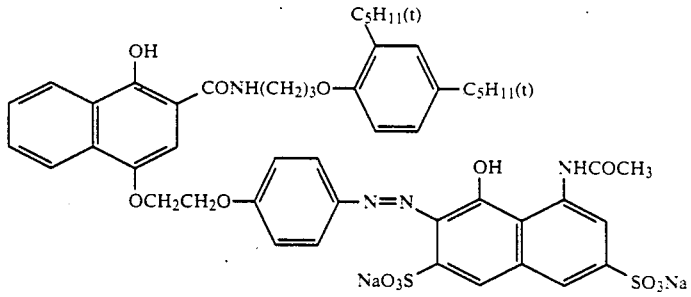

C-3

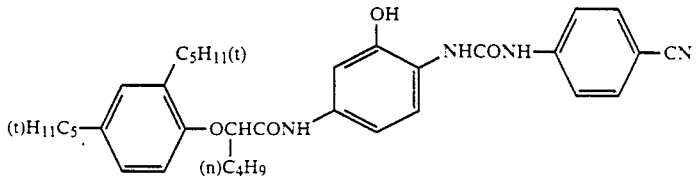

-continued
C-4
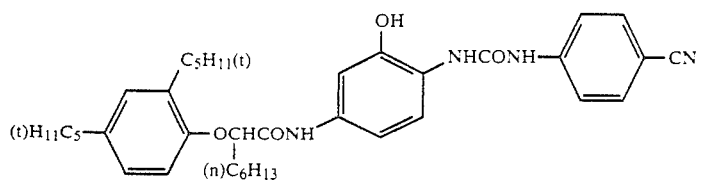
C-5
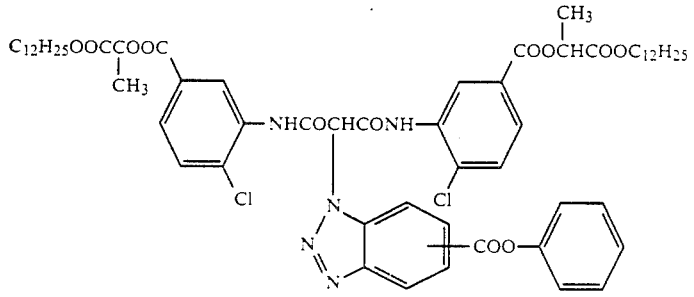
C-6
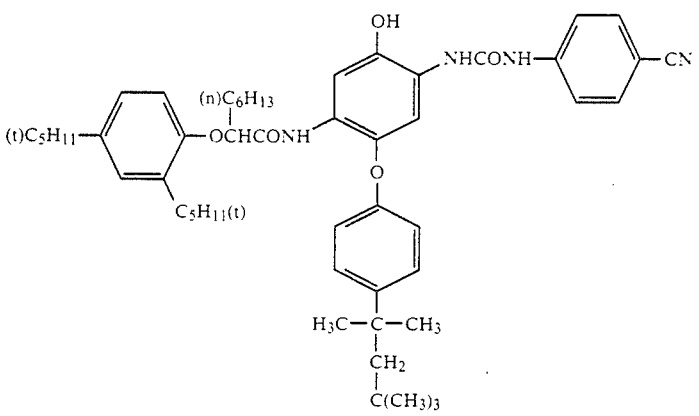
C-7
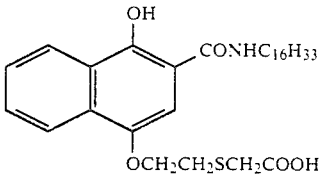
C-8
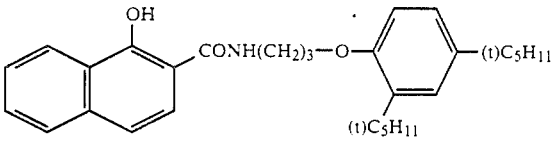
C-9
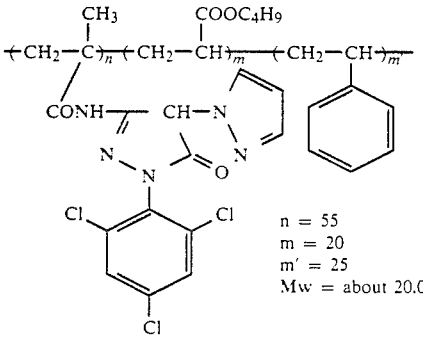
n = 55
m = 20
m' = 25
Mw = about 20.000

-continued
C-10
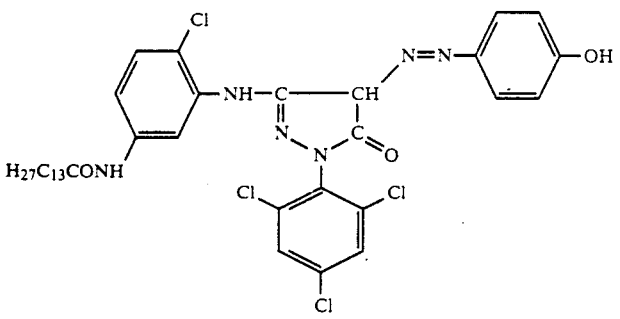
C-11
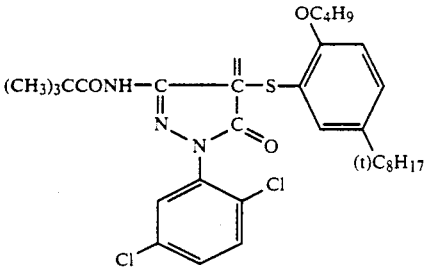
C-12
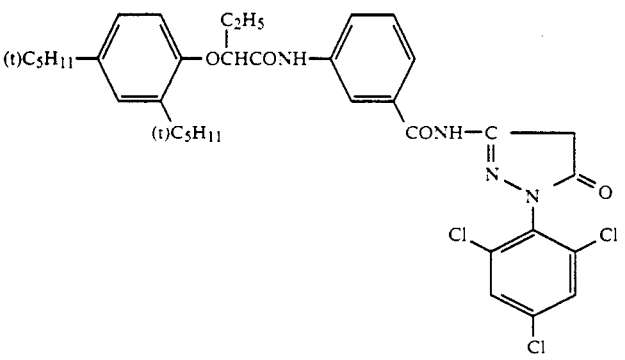
C-13
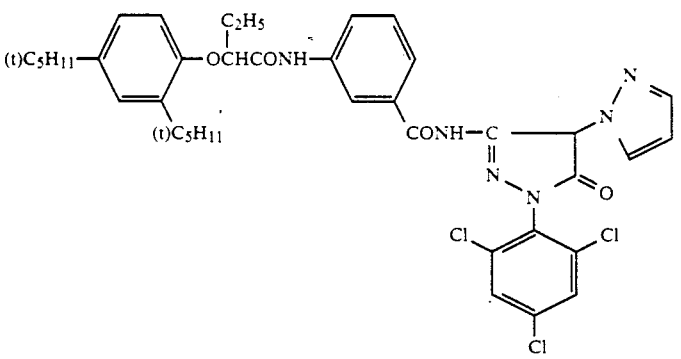
C-14
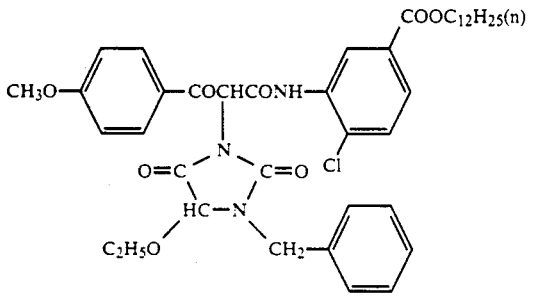

-continued
C-15
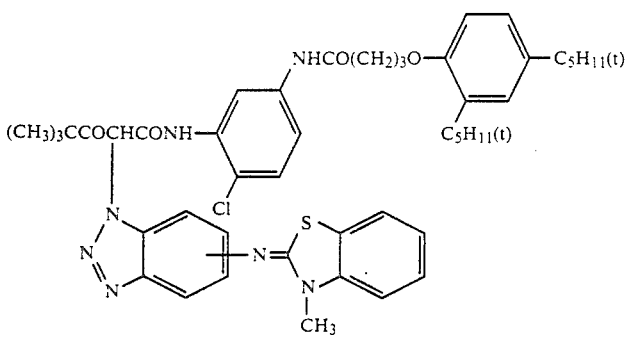
Cpd-A
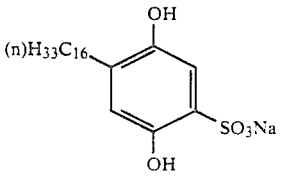
Cpd-B
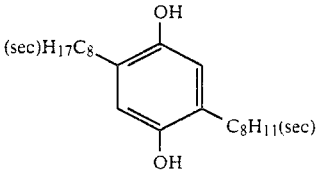
Cpd-C
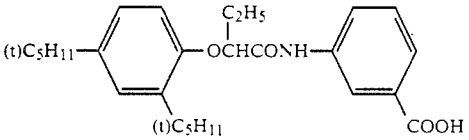
Sensitizing Dye I
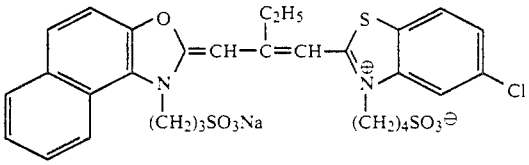
Sensitizing Dye II
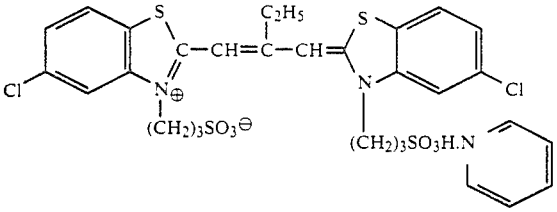
Sensitizing Dye III
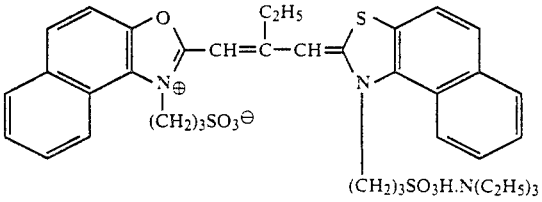
Sensitizing Dye IV
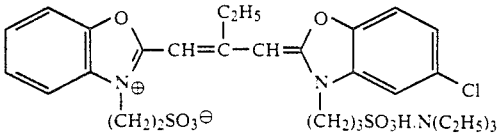

-continued

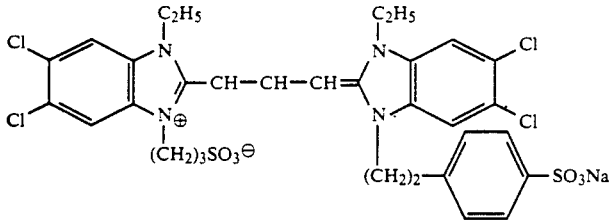

Sensitizing Dye V

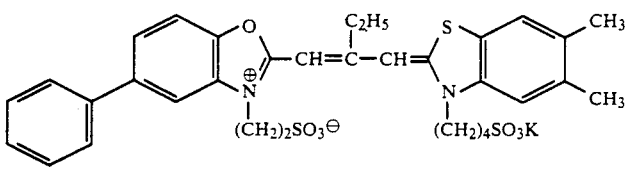

Sensitizing Dye VI

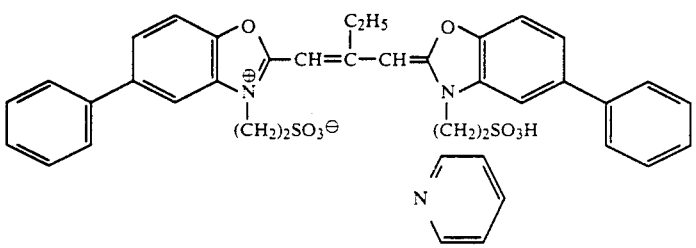

Sensitizing Dye VII

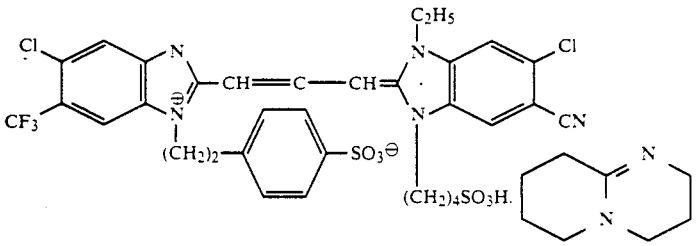

Sensitizing Dye VIII

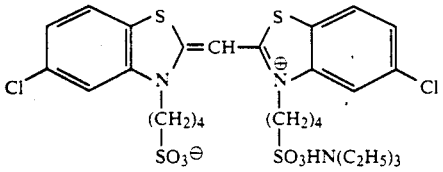

Sensitizing Dye IX

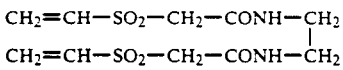

H-1

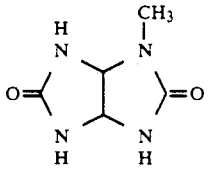

S-1

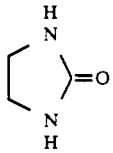

S-2

On the other hand, multilayered color paper for print having the following layer structure (Sample B) was produced by applying coating solutions to the surface of a paper substrate whose both sides had been laminated with polyethylene films. The coating solutions were prepared as follows:

Preparation of the Coating Solution for First Layer

An yellow coupler ExY-1 (19.1 g) and a color image stabilizer Cpd-1 (4.4 g) were dissolved in a mixture of 27.2 cc of ethyl acetate and 7.7 cc (8.0 g) of a high boiling point solvent Solv-1 and the resulting solution was dispersed in 185 cc of 10% aqueous solution of gelatin containing 8 cc of 10% sodium dodecylbenzene sulfonate to form an emulsion. The emulsion was mixed with and dispersed in emulsions EM 7 and EM 8 and the concentration of gelatin was adjusted so as to be consistent with the following composition to obtain the coating solution for 1st layer. The coating solutions for 2nd to 7th layers were also prepared in the same manner. To each layer, sodium salt of 1-oxy-3,5-dichloro-s-triazine was added as a gelatin hardening agent. Moreover, a compound Cpd-2 was used as a thickening agent.

Layer Structure

The composition of each layer is given below. Numerical values represent coated amount expressed in g/m$^2$. The amount of silver halide emulsion is expressed in the amount of silver.

| Substrate: Paper laminated with polyethylene films (the polyethylene film on the side of the first layer includes a white pigment ($TiO_2$) and a bluing dye.) | |
|---|---|
| 1st Layer: Blue-sensitive Emulsion Layer | |
| Monodisperse silver chlorobromide emulsion spectrally sensitized with a sensitizing dye ExS-1 (EM 7) | 0.15 |
| Monodisperse silver chlorobromide emulsion spectrally sensitized with a sensitizing dye ExS-1 (EM 8) | 0.15 |
| Gelatin | 1.86 |
| Yellow coupler ExY-1 | 0.82 |
| Color image stabilizer Cpd-2 | 0.19 |
| Solvent Solv-1 | 0.35 |
| 2nd Layer: Color Mixing Inhibiting Layer | |
| Gelatin | 0.99 |
| Color mixing inhibitor Cpd-3 | 0.08 |
| 3rd Layer: Blue-sensitive Emulsion Layer | |
| Monodisperse silver chlorobromide emulsion spectrally sensitized with sensitizing dyes ExS-2 and 3 (EM 9) | 0.12 |
| Monodisperse silver chlorobromide emulsion spectrally sensitized with sensitizing dyes ExS-2 and 3 (EM 10) | 0.24 |
| Gelatin | 1.24 |
| Magenta coupler ExM-1 | 0.39 |
| Color image stabilizer Cpd-4 | 0.25 |
| Color image stabilizer Cpd-5 | 0.12 |
| Solvent Solv-2 | 0.25 |
| 4th Layer: Ultraviolet Absorbing Layer | |
| Gelatin | 1.60 |
| Ultraviolet absorber (Cpd-6/Cpd-7/Cpd-8 = | 0.70 |

-continued

| Substrate: Paper laminated with polyethylene films (the polyethylene film on the side of the first layer includes a white pigment ($TiO_2$) and a bluing dye.) | |
|---|---|
| 3/2/6: weight ratio) | |
| Color mixing inhibitor Cpd-9 | 0.05 |
| Solvent Solv-3 | 0.42 |
| 5th Layer: Red-sensitive Emulsion Layer | |
| Monodisperse silver chlorobromide emulsion spectrally sensitized with sensitizing dyes ExS-4 and 5 (EM 11) | 0.07 |
| Monodisperse silver chlorobromide emulsion spectrally sensitized with sensitizing dyes ExS-4 and 5 (EM 12) | 0.16 |
| Gelatin | 0.92 |
| Cyan coupler ExC-1 | 1.46 |
| Cyan coupler ExC-2 | 1.84 |
| Color image stabilizer (Cpd-7/Cpd-8/Cpd-10 = 3/4/2: weight ratio) | 0.17 |
| Polymer for dispersion Cpd-11 | 0.14 |
| Solvent Solv-1 | 0.20 |
| 6th Layer: Ultraviolet Absorbing Layer | |
| Gelatin | 0.54 |
| Ultraviolet absorber (Cpd-6/Cpd-8/Cpd-10 = 1/5/3: weight ratio) | 0.21 |
| Solvent Solv-4 | 0.08 |
| 7th Layer: Protective Layer | |
| Gelatin | 1.33 |
| Acrylic modified copolymer of polyvinyl alcohol (degree of modification = 17%) | 0.17 |
| Liquid paraffin | 0.03 |

In this respect, Cpd-12 and Cpd-13 were used as irradiation inhibiting agents.

Each layer further comprises Alkanol XC (available from Dupont Co.), sodium alkylbenzene sulfonate, succinate and Megafac F-120 (available from DAINIPPON INK AND CHEMICALS, INC.) as an emulsifying and dispersing agent and a coating aid. In addition, Cpd-14 and Cpd-15 were used as stabilizer for silver halide.

The emulsions used are detailed below:

| Emulsion | Shape | Grain size (micron) | Br content (mole %) | C.V.* |
|---|---|---|---|---|
| EM 7 | cubic | 1.1 | 1.0 | 0.10 |
| EM 8 | " | 0.8 | 1.0 | 0.10 |
| EM 9 | " | 0.45 | 1.5 | 0.09 |
| EM 10 | " | 0.34 | 1.5 | 0.09 |
| EM 11 | " | 0.45 | 1.5 | 0.09 |
| EM 12 | " | 0.34 | 1.6 | 0.10 |

*Coefficient of variation (this means the distribution of grains: standard deviation/average size)

The structural formulas of the compounds used are as follows:

ExY-1

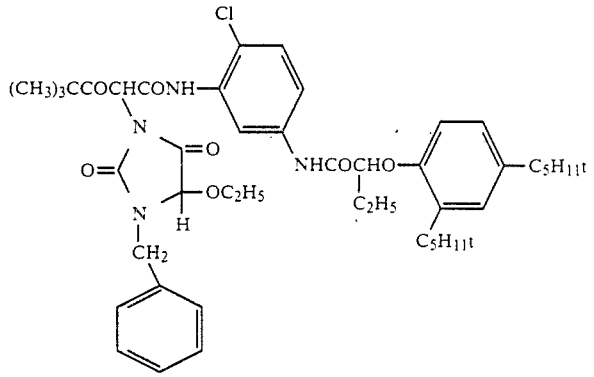

-continued
ExM-1
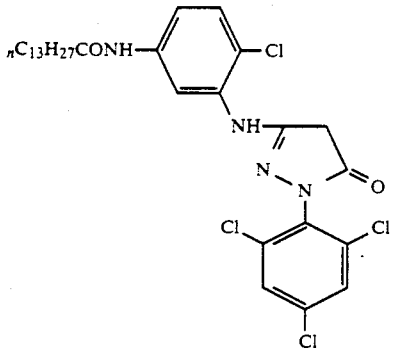
ExC-1
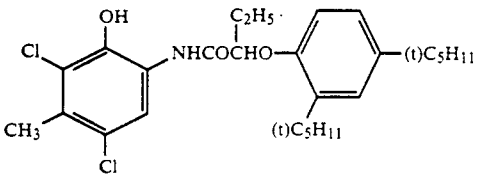
ExC-2
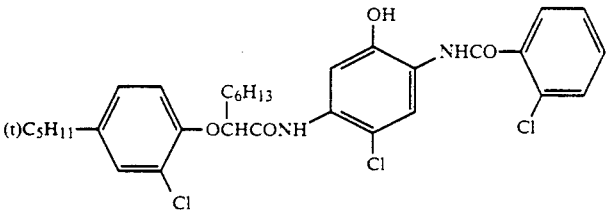
ExS-1
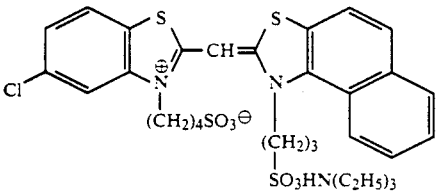
ExS-2
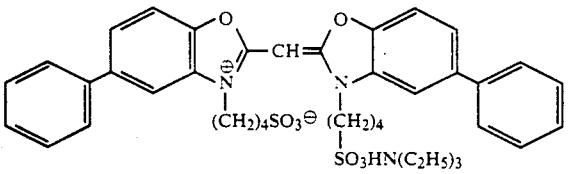
ExS-3
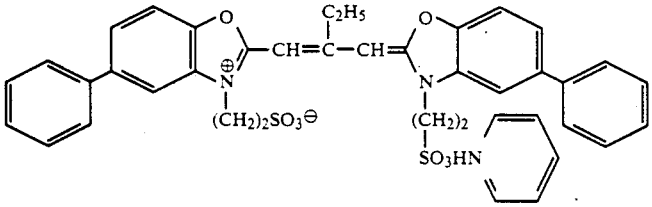
ExS-4
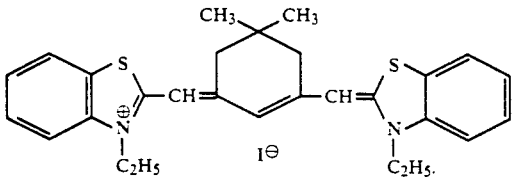

-continued
ExS-5
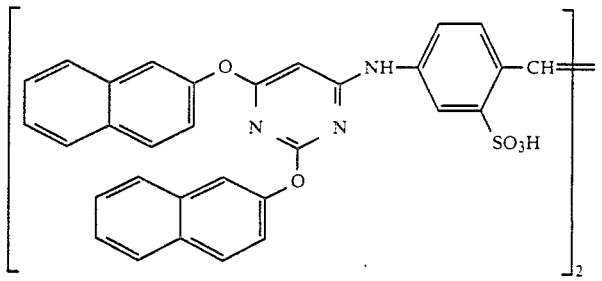
Cpd-1
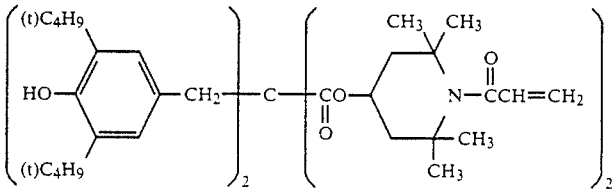
Cpd-2
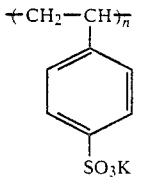
Cpd-3
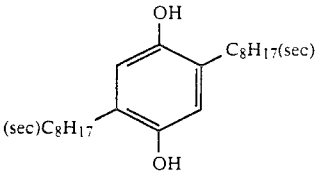
Cpd-4
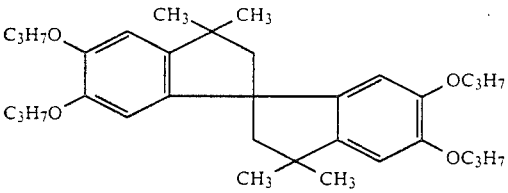
Cpd-5
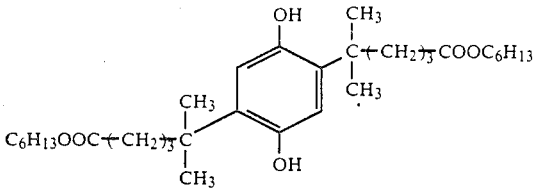
Cpd-6
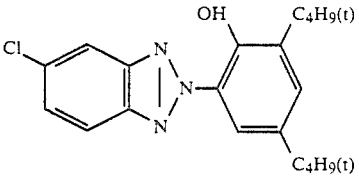
Cpd-7
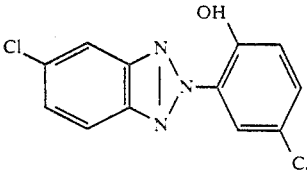

-continued
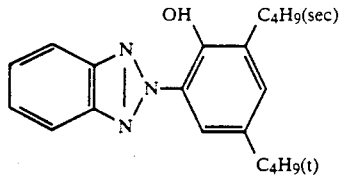
Cpd-8
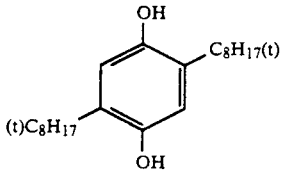
Cpd-9
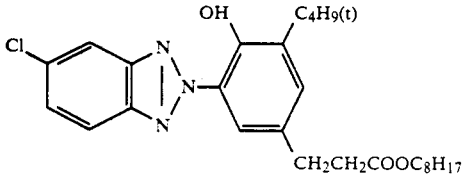
Cpd-10
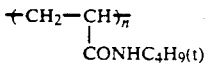
Cpd-11
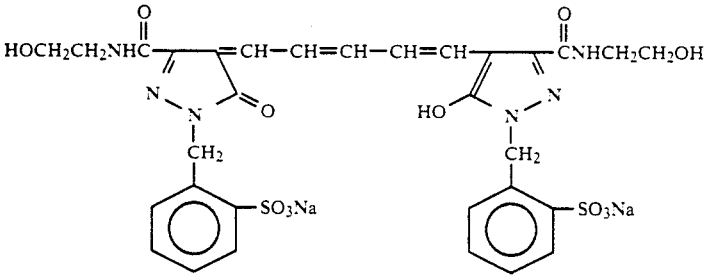
Cpd-12
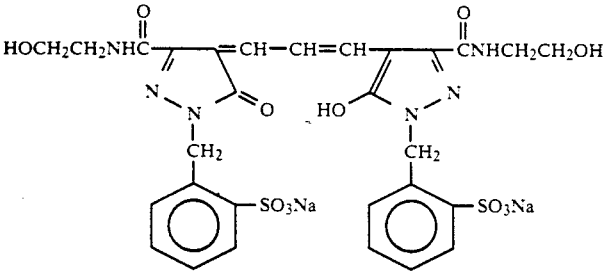
Cpd-13
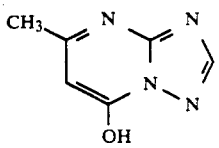
Cpd-14
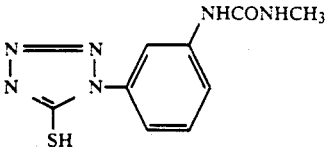
Cpd-15
Dibutyl Phthalate — Solv-1
Trioctyl Phthalate — Solv-2
Trinonyl Phthalate — Solv-3
Tricresyl Phsphate — Solv-4

Samples A and B thus prepared were imagewise exposed to light, were processed in separate developers using processing baths shown in FIG. 1 and then were processed in a common bleach-fixing solution, a common fixing solution and a common water washing solution in this order. The processing conditions are as follows:

| Process | Temp. (°C.) | Time (sec.) | Amount Replenished (ml/m²) | Tank Volume (liter) |
|---|---|---|---|---|
| (i) Color Negative Film (Sample A) | | | | |
| Color Development A | 38 | 195 | 600 | 10 |
| Bleaching (common) | 38 | 180 | 267 | 20 |
| Fixing (common) | 38 | 120 | 267 | 20 |
| Water Washing (1) (common) | 35 | 60 | — | 10 |
| Water Washing (2) (common) | 35 | 60 | — | 10 |
| Water Washing (3) (common) | 35 | 60 | 400* | 10 |
| Drying | 60 | 180 | — | — |
| (ii) Color Paper (Sample B) | | | | |
| Color Development B | 35 | 45 | 100 | 10 |
| Bleaching (common) | 38 | 45 | 100 | 20 |
| Fixing (common) | 38 | 45 | 100 | 20 |
| Water Washing (1) (common) | 35 | 30 | — | 10 |
| Water Washing (2) (common) | 35 | 30 | — | 10 |
| Water Washing (3) (common) | 35 | 30 | 200* | 10 |
| Drying | 80 | 40 | — | — |

*The water washing was carried out by 3-tank cascade system from tank (3) to (1).

The color negative film and the color paper (12 m² per 1 ² m of the former) were continuously processed for 30 days until the total amount of color negative film became 40 m².

The composition of each processing solution is as follows. In this connection, the compositions of the color developer (B) and the bleaching solution were changed as in Table I and the running tests were performed using each processing solution.

| | Tank Soln. (g) | Replenisher (g) |
|---|---|---|
| Color Developer (A) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | 0.3 |
| Potassium iodide | 1.5 (mg) | — |
| Hdroxylamine sulfate | 2.4 | 3.6 |
| 4-(N-Ethyl-N-beta-hydroxyethyl-amino)-2-methylaniline sulfate | 4.5 | 7.2 |
| Water | ad. 1.0 l | ad. 1.0 l |
| pH | 10.05 | 10.10 |
| Color Developer (B) | | |
| Water | 800 (ml) | 800 (ml) |
| Ethylenediaminetetraacetic acid | 2.0 | 2.0 |
| 5,6-Dihydroxybenzene-1,2,4-trisulfonic acid | 0.3 | 0.3 |
| Triethanolamine | 8.0 | 8.0 |
| Sodium chloride | 1.4 | — |
| Potassium carbonate | 25 | 0 |
| N-Ethyl-N-(beta-methanesulfon-amidoethyl)-3-methyl-4-amino-aniline sulfate | 5.0 | 0 |
| Diethylhydroxylamine | 4.2 | 0 |
| Diethylhydroxylamine | 4.2 | 0 |
| Fluorescent brightener | (see Table I) | |
| Benzyl alcohol | (see Table I) | |
| Water | ad. 1.0 l | ad. 1.0 l |
| pH | 10.10 | 10.20 |
| Bleaching Solution | | |
| Fluorescent brightener | (see Table I) | |
| Bis(2-dimethylaminoethyl)-disulfide hydrochloride | 1.0 | 2.0 |
| Ferric sodium ethylenediamine-tetraacetate trihydrate | 100.0 | 140.0 |
| Disodium ethylenediaminetetra-acetate | 10.0 | 11.0 |
| Ammonium bromide | 140.0 | 180.0 |
| Ammonium nitrate | 30.0 | 40.0 |
| 27% Aqueous ammonia | 6.5 (ml) | 2.5 (ml) |
| Water | ad. 1.0 l | ad. 1.0 l |
| pH | 6.0 | 5.5 |
| Fixing Solution | | |
| Disodium ethylenediaminetetra-acetate | 0.5 | 1.0 |
| Sodium sulfite | 7.0 | 12.0 |
| Sodium bisulfite | 5.0 | 9.5 |
| 70% Aqueous solution of ammonium thiosulfate | 170.0 (ml) | 240.0 (ml) |
| Water | ad. 1.0 l | ad. 1.0 l |
| pH | 6.7 | 6.6 |

Water Washing Solution (Tank Soln. and Replenisher)

The water washing solution was prepared by passing tap water through a mixed bed column packed with H-type strong acidic cation exchange resin (Amberlite IR-120B; available from Rohm & Haas Co.) and OH-type anion exchange resin (Amberlite IR-400; available from the same company) to reduce the concentrations of calcium and magnesium to not more than 3 mg/l respectively and then adding 20 mg/l of sodium dichloroisocyanurate and 1.5 g/l of sodium sulfate. The pH value of this solution was 6.5 to 7.5.

At the time of starting the running tests and after the end thereof, the magenta stains and the amount of silver remaining at Dmax portions (after the running process) of the color negative film and the color paper which had been wedge exposed to light were determined using Macbeth densitometer and fluorescent X-rays and the difference between the magenta stains before and after the running test (ΔGDmin) was estimated. The results are listed in Table I. In Table I, the fluorescent brightener concentration in the bleaching solution at the end of the running was determined by UV absorption and the iodide ion concentration in the fixing solution (originated from those dissolved out from the processed light-sensitive material) was also determined by ion chromatography technique. The results are also summarized in Table I.

TABLE I

| | Color Developer B | | | Bleaching Soln. | |
|---|---|---|---|---|---|
| | F.B. | | B.E. | F.B. | |
| Test No. | Kind | TS/Re. (g/l) | TS/Re. (ml/l) | Kind | TS/Re. (g/l) |
| 1* | — | — | — | — | — |
| 2* | III-3 | 2.0/4.0 | — | — | — |
| 3* | III-3 | 2.0/4.0 | — | — | — |
| 4 | III-3 | 2.0/4.0 | — | — | — |
| 5 | — | — | — | III-3 | 1.0/1.5 |

TABLE I-continued

| | | | | | |
|---|---|---|---|---|---|
| 6 | — | — | 15/20 | III-3 | 1.0/1.5 |
| 7 | III-6 | 2.0/4.0 | 15/20 | — | — |
| 8 | III-6 | 2.0/4.0 | — | — | — |
| 9 | III-41 | 1.5/2.0 | 5/8 | — | — |
| 10 | III-41 | 1.5/2.0 | — | — | — |
| 11 | — | — | — | III-40 | 0.5/1.0 |

| | Running Equ. Soln. (analyzed) | | Color nega. Film | | Color Paper | |
|---|---|---|---|---|---|---|
| Test No. | F.B. (g/l) | I ion as KI:g/l | ΔDGmin | Ag μg/cm² | ΔDGmin | Ag μg/cm² |
| 1* | — | 0.2 | +0.05 | 13.5 | +0.01 | 11.5 |
| 2* | 0.2 | — | +0.02 | 8.4 | +0.01 | 8.3 |
| 3* | 0.2 | 0.01 | +0.02 | 8.0 | +0.01 | 7.9 |
| 4 | 0.2 | 0.2 | 0 | 2.4 | 0 | 2.1 |
| 5 | 1.1 | 0.2 | 0 | 1.8 | 0 | 1.0 |
| 6 | 1.1 | 0.2 | +0.02 | 5.1 | +0.02 | 4.9 |
| 7 | 0.2 | 0.2 | +0.02 | 4.9 | +0.02 | 5.3 |
| 8 | 0.2 | 0.2 | 0 | 2.2 | 0 | 1.5 |
| 9 | 0.1 | 0.2 | +0.02 | 4.6 | +0.02 | 4.8 |
| 10 | 0.1 | 0.2 | 0 | 2.8 | 0 | 2.0 |
| 11 | 0.5 | 0.2 | 0 | 2.1 | 0 | 1.1 |

*Comparative Example

Note 1: In test No. 2, only color paper was processed and thus iodide ions were not present in the running solution.

Note 2: In test No. 3, 240 m² of the color paper per 1 m² of color negative film was processed.

Note 3: In Table I, abbreviations F.B.; TS/Re and B.E. mean fluorescent brightener, tank solution/replenisher and benzylalcohol respectively.

As seen the results listed in Table I, unlike the present invention, the stains and the amount of remaining silver are high when the bleaching solution does not contain a fluorescent brightener (test No.1) and when the fixing solution contains no iodide ions (test No.2). Moreover, when the amount of iodide ions in the fixing solution is outside the range defined in the present invention (test No. 3), the reduction of stains and the desilvering properties are insufficient. When these two conditions are both satisfied, the stains and the amount of residual silver are substantially reduced and more excellent effects can be attained when the color developer B does not contain benzylalcohol (see test Nos. 4, 5, 8, 10 and 11). In addition, in test Nos. 4 and 7 to 10, these effects are achieved by carrying over the fluorescent brightener from the color developer B to the bleach-fixing solution.

EXAMPLE 2

Samples A-2 to A-4 were prepared in the same manner as in Example 1 except that the amount of coated silver in Sample A was changed to those listed below.

| | Sample | | | |
|---|---|---|---|---|
| | A | A-2 | A-3 | A-4 |
| 1st Layer | 0.2 | 0.2 | 0.2 | 0.2 |
| 2nd Layer | 0.15 | 0.15 | 0.15 | 0.15 |
| 3rd Layer | 0.4 | 0.5 | 0.5 | 0.3 |
| 4th Layer | 0.7 | 0.8 | 0.8 | 0.6 |
| 5th Layer | 1.0 | 1.1 | 1.1 | 0.9 |
| 7th Layer | 0.3 | 0.4 | 0.4 | 0.3 |
| 8th Layer | 0.4 | 0.5 | 0.5 | 0.4 |
| 9th Layer | 0.85 | 0.85 | 1.0 | 0.75 |
| 10th Layer | 0.08 | 0.10 | 0.10 | 0.08 |
| 11th Layer | 1.0 | 1.0 | 1.2 | 0.90 |
| 12th Layer | 0.4 | 0.4 | 0.5 | 0.4 |
| 14th Layer | 0.5 | 0.5 | 0.5 | 0.5 |
| TOTAL (g/m²) | 5.98 | 7.0 | 7.45 | 5.48 |

Samples B-2 to B-4 were likewise prepared in the same manner as in Example 1 (Sample B) except that the amount of coated silver in Sample B was changed to those listed below.

| | Sample | | | |
|---|---|---|---|---|
| | B | B-2 | B-3 | B-4 |
| 1st Layer | 0.30 | 0.26 | 0.24 | 0.20 |
| 3rd Layer | 0.36 | 0.33 | 0.29 | 0.25 |
| 5th Layer | 0.23 | 0.20 | 0.18 | 0.15 |
| TOTAL (g/m²) | 0.89 | 0.79 | 0.69 | 0.60 |

Each Sample thus prepared was imagewise exposed to light, developed in separate developers and then processed in the common processing solutions (only in the processing of the color negative films, a stabilization process was included). The processing conditions are summarized in Table II given below.

TABLE II

| Process | Temp. (°C.) | Time (sec.) | Amount Replenished (ml/m²) | Tank Volume (liter) |
|---|---|---|---|---|
| | | (i) Color Negative Film | | |
| Color Development C | 38 | 195 | 400 | 10 |
| Bleach-fixing (common) | 38 | 240 | 400 | 15 |
| Rinse (1) (common) | 35 | 60 | — | 5 |
| Rinse (2) (common) | 35 | 60 | 400* | 5 |
| Stabilization | 35 | 30 | 400 | 5 |
| Drying | 60 | 180 | — | — |
| | | (ii) Color Paper | | |
| Color Development D | 35 | 60 | 80 | 10 |
| Bleach-fixing (common) | 38 | 45 | 150 | 10 |
| Rinse (1) (common) | 35 | 20 | — | 5 |
| Rinse (2) (common) | 35 | 20 | — | 5 |
| Rinse (3) | 35 | 20 | 300** | 5 |
| Drying | 80 | 30 | — | — |

*The rinsing was carried out by 2-tank cascade system from tank (2) to (1).

**The rinsing was carried out by 3-tank cascade system from tank (3) to (1).

The color negative film and the color paper (12 m² per 1 m² of the former) were continuously processed for 30 days until the amount of the processed color negative film was 60 m². The compositions of the processing solutions used are as follows:

| Color Developer C | Tank Soln. (g) | Replenisher (g) |
|---|---|---|
| Diethylenetriaminepentaacetic acid | 2.0 | 2.0 |
| Sodium sulfite | 4.0 | 4.9 |
| Potassium carbonate | 30.0 | 30.0 |
| Potassium bromide | 1.4 | — |
| Potassium iodide | 1.5 (mg) | — |
| Hydroxylamine sulfate | 2.4 | 3.6 |
| 4-(N-ethyl-N-beta-hydroxyethyl-amino)-2-methylaniline sulfate | 4.5 | 7.2 |
| Water | ad. 1.01 | ad. 1.01 |
| pH | 10.05 | 10.10 |

| Color Developer D | Tank Soln. (g) | Replenisher (g) |
|---|---|---|
| Water | 800 (ml) | 800 (ml) |
| Ethylenediamine-N,N,N',N'-tetramethylene phosphonic acid | 1.5 | 1.5 |
| Triethylenediamine(1,4-diazabicyclo(2,2,2)octane) | 5.0 | 5.0 |
| Sodium chloride | 2.4 | — |
| Potassium carbonate | 25 | 25 |

-continued

| | | |
|---|---|---|
| N-Ethyl-N-(beta-methanesulfonamido-ethyl)-3-methyl-4-aminoaniline sulfate | 5.0 | 9.0 |
| Diethylhydroxylamine | 4.2 | 8.0 |
| Fluorescent brightener | (see Table II) | |
| Water | ad. 1000 ml | ad. 1000 (ml) |
| pH | 10.05 | 10.45 |

| Bleach-fixing Solution | Tank Soln. | Replenisher |
|---|---|---|
| Ferric ammonium ethylenediamine-tetraacetate dihydrate | 90.0 g | 150 g |
| Disodium ethylenediaminetetra-acetate | 5.0 g | 5.0 g |
| Sodium sulfite | 12.0 g | 30 g |
| 70% Aqueous solution of ammonium thiosulfate | 260.0 ml | 300 ml |
| 98% Acetic acid | 5.0 ml | 10.0 ml |
| Bleaching accelerator | 0.01 mole | 0.02 mole |

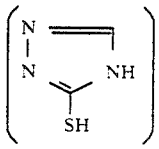

| | | |
|---|---|---|
| Water | ad. 1.01 | ad. 1.01 |
| pH | 6.0 | 5.5 |

| Washing water (Tank Soln. and Replenisher) | |
|---|---|
| Benzotriazole | 1.0 g |
| Ethylenediamine-N,N,N',N'-tetramethylene-phosphonic acid | 0.3 g |
| Water | ad. 1000 ml |
| pH | 7.0 |

| Stabilization Solution | Tank Soln. (g) | Replenisher (g) |
|---|---|---|
| 37% Formalin | 2.0 (ml) | 3.0 (, l) |
| Polyoxyethylene p-monononylphenyl ether (average degree of polymerization = 10) | 0.3 | 0.45 |
| Disodium ethylenediaminetetra-acetate | 0.05 | 0.08 |
| Water | ad. 1.01 | ad. 1.01 |
| pH | 5.0-8.0 | 5.0-8.0 |

As in Example 1, the running tests were performed by exchanging the kind of the color negative films and the color paper and the kind of the fluorescent brighteners to determine ΔDGmin and the amount of residual silver in the light-sensitive materials. The results obtained are listed in Table III. As seen from the results listed in Table III, when the fluorescent brightener and iodide ions are present in the bleach-fixing solution (test Nos. 2 and 4 to 11), the magenta stains are greatly reduced and the desilvering properties are also extremely improved. In particular when the coated amount of silver of the color negative film is not more than 7.0 g/m$^2$ and that of the color paper is not more than 0.8 g/m$^2$, it is found that the desilvering properties are extremely improved (see test Nos. 3, 6, 9, 10 and 11).

TABLE III

| Test No. | Processed light-sensitive material C.N.F. | C.P. | Color Developer D F.B. | TS/Re (g/l) |
|---|---|---|---|---|
| 1* | A | B | — | — |
| 2 | A | B | III-3 | 3.0/4.5 |
| 3* | A-4 | B-4 | — | — |
| 4 | A-4 | B-4 | III-3 | 1.0/2.0 |
| 5 | A-3 | B-2 | III-3 | 1.0/2.0 |
| 6 | A-2 | B-3 | III-3 | 1.0/2.0 |
| 7 | A-3 | B-4 | III-3 | 1.0/2.0 |
| 8 | A-4 | B | III-3 | 1.0/2.0 |

TABLE III-continued

| | | | | |
|---|---|---|---|---|
| 9 | A-4 | B-2 | III-3 | 1.0/2.0 |
| 10 | A-4 | B-2 | III-6 | 1.0/2.0 |
| 11 | A-4 | B-2 | III-41 | 1.0/2.0 |

| Test No. | Bleach-fixing running eq. soln. F.B. (g/l) | I ions as KI:g/l | Color negative film ΔDGmin | Ag (μg/cm$^2$) | Color paper ΔDGmin | Ag (μg/cm$^2$) |
|---|---|---|---|---|---|---|
| 1* | — | 0.15 | +0.03 | 18.3 | +0.02 | 12.1 |
| 2 | 0.6 | 0.15 | +0.01 | 5.5 | 0 | 4.9 |
| 3* | — | 0.12 | +0.03 | 15.3 | +0.02 | 8.1 |
| 4 | 0.2 | 0.12 | 0 | 2.1 | 0 | 1.0 |
| 5 | 0.2 | 0.21 | +0.01 | 5.8 | 0 | 5.1 |
| 6 | 0.2 | 0.18 | 0 | 2.8 | 0 | 1.9 |
| 7 | 0.2 | 0.21 | 0 | 6.0 | 0 | 2.0 |
| 8 | 0.2 | 0.12 | 0 | 4.5 | 0 | 5.6 |
| 9 | 0.2 | 0.12 | 0 | 2.0 | 0 | 1.8 |
| 10 | 0.2 | 0.12 | 0 | 1.9 | 0 | 1.8 |
| 11 | 0.2 | 0.12 | 0 | 1.8 | 0 | 1.9 |

*Comparative Test.

Note 1: Abbreviations C.N.F. and C.P. mean color negative film and color paper respectively.

EXAMPLE 3

Samples of color paper (Samples C, D, E, F and G) were prepared in the same manner as in Example 1 except that the magenta coupler in Sample B was changed to those detailed below:

Sample C

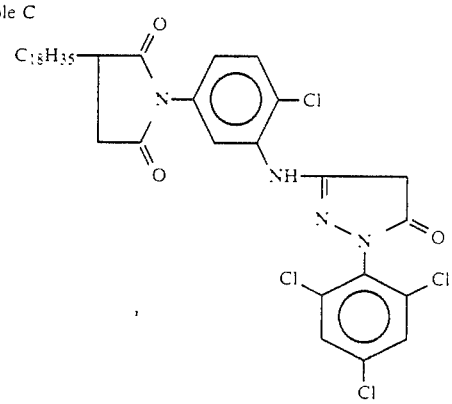

Sample D: M-26 Sample E: M-29

Sample F: m-7 Sample G: m-14

Then, the foregoing Samples and Sample A (color negative film) were imagewise exposed to light, each combination of a color paper and a color negative film was processed in the same processing bath(s). The processing conditions are listed in Table IV. Moreover, the processing apparatus used herein is one schematically shown in FIG. 3. In this Example, the stabilization solution was substituted for the water washing solution.

TABLE IV

| Process | Temp. (°C.) | Time (sec.) | Amount Replenished (ml/m$^2$) | Tank Volume (liter) |
|---|---|---|---|---|
| (i) Color Negative Film | | | | |
| Color Development E | 38 | 165 | 400 | 10 |
| Bleach-fixing (common) | 38 | 240 | 400 | 15 |
| Stabilization (1) (common) | 35 | 30 | — | 5 |
| Stabilization | 35 | 30 | — | 5 |

TABLE IV-continued

| Process | Temp. (°C.) | Time (sec.) | Amount Replenished (ml/m²) | Tank Volume (liter) |
|---|---|---|---|---|
| (2) (common) Stabilization | 35 | 30 | 200* | 5 |
| (3) (common) Drying | 60 | 120 | — | — |
| (ii) Color Paper | | | | |
| Color Development F | 38 | 45 | 150 | 10 |
| Bleach-fixing | 38 | 45 | 150 | 10 |
| Stabilization (1) (common) | 35 | 20 | — | 5 |
| Stabilization (2) (common) | 35 | 20 | — | 5 |
| Stabilization (3) (common) | 35 | 20 | 200* | 5 |
| Drying | 80 | 30 | — | — |

*The stabilization was carried out by 3-tank cascade system from tank (3) to (1).

The compositions of the processing solutions are as follows:

Color Developer E: The same as the color developer C used in Example 2.

| Color Developer F | Tank Soln. (g) | Replenisher (g) |
|---|---|---|
| Ethylenediaminetetraacetic acid | 2.0 | 2.0 |
| Catechol-1,2,4-trisulfonic acid | 300 (mg) | 300 (mg) |
| Sodium chloride | 1.0 | — |
| Potassium carbonate | 25 | 25 |
| N,N-Dicarboxymethylhydrazine | 5.0 | 7.0 |
| Triethanolamine | 10 | 10 |
| N-Ethyl-N-(beta-methanesulfonamidoethyl)-3-methyl-4-aminoaniline sulfate | 5.0 | 7.5 |
| Fluorescent brightener | (see Table V) | |
| Water | ad. 1000 (ml) | ad. 1000 (ml) |
| pH | 10.05 | 10.10 |

Bleach fixing Solution: The same as that used in Example 2.

| Stabilization Solution | Tank Soln. | Replensiher |
|---|---|---|
| 37% Formalin | 1.0 ml | 1.5 ml |
| Polyoxyethylene p-mononylphenyl ether (average degree of polymerization = 10) | 0.2 g | 0.3 g |
| Ethylenediaminetetraacetic acid | 0.05 g | 0.08 g |
| 1-Hydroxyethylidene-1,1-diphosphonic acid (60%) | 1.0 ml | 1.0 ml |
| 5-Chloro-2-methyl-4-isothiazolin-3-one | 0.05 g | 0.05 g |
| 2-Octyl-4-isothiazolin-3-one | 0.05 g | 0.05 g |
| 26% Aqueous ammonia | 1.3 ml | 1.3 ml |
| Water | ad. 1000 ml | ad. 1000 ml |
| pH | 6.0 | 5.5 |

As in Example 2, the light-sensitive materials A and B to G were processed in the same bath(s) and the amount of remaining silver after the processing and the increase in yellow density of the non-image portions of the color paper observed after storing at 80° C. for one month were determined. The results obtained are summarized in Table V.

TABLE V

| Test No. | Processed light-sensitive material C.N.F. | C.P. | Color Developer F F.B. | TS/Re (g/l) |
|---|---|---|---|---|
| 1* | A | B | — | — |
| 2* | A | D | — | — |
| 3* | A | F | — | — |
| 4 | A | B | III-3 | 2.0/2.8 |
| 5 | A | C | III-3 | 2.0/2.8 |
| 6 | A | D | III-3 | 2.0/2.8 |
| 7 | A | E | III-3 | 2.0/2.8 |
| 8 | A | F | III-3 | 2.0/2.8 |
| 9 | A | G | III-3 | 2.0/2.8 |
| 10 | A | C | III-41 | 1.5/2.0 |
| 11 | A | E | III-41 | 1.5/2.0 |
| 12 | A | F | III-41 | 1.5/2.0 |

| Test No. | Bleach-fixing running eq. soln. F.B. (g/l) | I ions as KI:g/l | Color negative film Ag | Color paper ΔDGmin | Ag (μg/cm²) |
|---|---|---|---|---|---|
| 1* | — | 0.15 | 17.9 | +0.29 | 11.9 |
| 2* | — | 0.15 | 17.8 | +0.21 | 12.1 |
| 3* | — | 0.15 | 17.7 | +0.23 | 12.2 |
| 4 | 0.40 | 0.15 | 5.4 | +0.19 | 5.1 |
| 5 | 0.40 | 0.15 | 5.3 | +0.20 | 5.3 |
| 6 | 0.40 | 0.15 | 4.9 | +0.09 | 1.9 |
| 7 | 0.40 | 0.15 | 4.8 | −0.10 | 2.1 |
| 8 | 0.40 | 0.15 | 4.7 | +0.08 | 2.3 |
| 9 | 0.40 | 0.15 | 4.8 | −0.07 | 2.1 |
| 10 | 0.30 | 0.15 | 5.1 | −0.19 | 5.0 |
| 11 | 0.30 | 0.15 | 4.7 | −0.09 | 2.0 |
| 12 | 0.30 | 0.15 | 4.6 | −0.07 | 1.9 |

*Comparative Test.

As seen from the results shown in Table V, the method of the present invention makes it possible to improve the desilvering properties and to reduce yellow stains even after storing the processed light-sensitive materials. In particular, if the preferred magenta couplers represented by formulas (I) and (II) are used, it is found that the effects of the invention are further enhanced (see Test Nos. 6 to 9, 11 and 12).

What is claimed is:

1. A method for processing at least 2 kinds of silver halide color photographic light-sensitive materials comprising the steps of development, desilvering, water washing and/or stabilization, wherein desilvering comprises processing, in a common desilvering bath, one silver halide color photographic light sensitive material having, applied to a substrate, a silver halide emulsion layer which contains, on average, not less than 2 mole % of silver iodide and another silver halide color photographic light sensitive material having, applied to a substrate, a silver halide emulsion layer which contains not more than 1 mole % of silver iodide, the desilvering bath comprising (A) a bleaching bath containing a processing solution having bleaching ability which contains at least one stilbene type fluorescent brightener and a fixing bath containing a processing solution having fixing ability which contains iodide ions ranging from $1\times10^{-4}$ to $1\times10^{-1}$ mole/l or (B) a bleach-fixing bath containing a solution having bleaching and fixing ability which contains at least one stilbene type fluorescent brightener and iodide ions ranging from $1\times10^{-4}$ to $1\times10^{-1}$ mole/l.

2. A method of claim 1 where in the desilvering bath comprises a bleaching bath containing the processing solution having bleaching ability and a fixing bath containing the processing solution having fixing ability.

3. A method of claim 1 wherein the desilvering bath is a bleach-fixing bath.

4. A method of claim 1 wherein the stilbene type fluorescent brightener is a member selected from the group consisting of compounds represented by the following general formula (III):

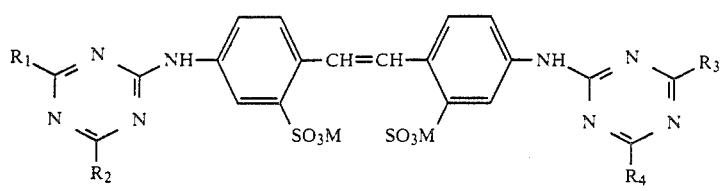

(III)

wherein $R_1$ to $R_4$ may be the same different and each represents a hydroxyl group, an alkoxy group having 1 to 4 carbon atoms, an amino group, an alkylamino group having 1 to 6 carbons atoms, an aryloxy group, an arylamino group, or a halogen atom; and M is a monovalent cation.

5. A method of claim 1 wherein the amount of the stilbene type fluorescent brightener in the processing solution having bleaching ability ranges from 0.1 to 20 g/l.

6. A method of claim 5 wherein the stilbene type fluorescent brightener is carried over from a preceding processing bath to the processing solution having bleaching ability.

7. A method of claim 1 wherein the iodide ions in the processing solution having fixing ability ranges from $5\times10^{-4}$ to $5\times10^{-2}$ mole/l.

8. A method of claim 7 wherein the iodide ions are those dissolved from the processed color light-sensitive materials.

9. A method of claim 1 wherein the content of silver iodide in said one color light-sensitive material ranges from 3 to 25 mole %.

10. A method of claim 1 wherein said one color light-sensitive material and said another color light-sensitive material are simultaneously processed in the common baths.

11. A method of claim 1 wherein said one color light-sensitive material and said another color light-sensitive material are successively processed.

12. A method of claim 1 wherein the color light-sensitive materials are processed in a common water washing bath and/or a common stabilization bath after the desilvering process.

13. A method of claim 1 wherein the color light-sensitive materials are developed in a common developing bath.

14. A method of claim 1 wherein said another color light-sensitive material contains at least one magenta coupler represented by the following formula (I) or (II).

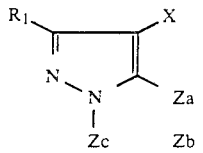

(I)

wherein $R_1$ represents a hydrogen atom or a substituent; X represents a hydrogen atom or a group capable of being eliminated through coupling reaction with an oxidized form of an aromatic primary amine developing agent; Za, Zb and Zc each represents a methine or substituted methine group or a group =N— or —NH— provided that one of the bonds Za—Zb and Zb—Zc is a double bond and the other is a single bond, that if the bond Zb—Zc is a carbon—carbon double bond, it may be a part of an aromatic ring, that the compound may form a dimer or a higher polymer at $R_1$ or X, and that if Za, Zb or Zc is a substituted methine group, the compounds may form a dimer or a higher polymer at the substituted methine.

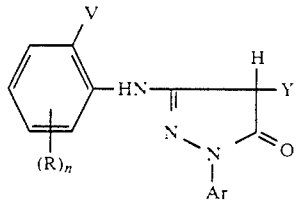

(II)

wherein Ar represents an optionally substituted phenyl group; Y represents a group capable of being eliminated through coupling reaction with an oxidized form of an aromatic primary amine developing agent; V represents a halogen atom, an alkoxy group or an alkyl group; R represents a group which may be a substituent for the benzene ring and n is an integer of 1 or 2 provided that if n is 2, the groups R may be the same or different.

* * * * *